US007069835B2

(12) United States Patent
Nishri et al.

(10) Patent No.: US 7,069,835 B2
(45) Date of Patent: Jul. 4, 2006

(54) STRIPED BRAIDED ELEMENT

(75) Inventors: Boaz Nishri, Maagan Michael (IL); Avraham Rapaport, Tel Aviv (IL); Gilad Cibulski, Moshav Herut (IL); Yaniv Fouks, Rishon LeZion (IL)

(73) Assignee: Surpass Medical Ltd., Tel-Aviv (IL)

( * ) Notice: Subject to any disclaimer, the term of this patent is extended or adjusted under 35 U.S.C. 154(b) by 0 days.

(21) Appl. No.: 11/028,045

(22) Filed: Jan. 4, 2005

(65) Prior Publication Data

US 2005/0150370 A1 Jul. 14, 2005

Related U.S. Application Data

(60) Provisional application No. 60/535,493, filed on Jan. 12, 2004.

(51) Int. Cl.
*D04C 1/00* (2006.01)

(52) U.S. Cl. ..... 87/11

(58) Field of Classification Search ..... 87/5, 87/8, 9, 11, 13, 21, 56, 61
See application file for complete search history.

(56) References Cited

U.S. PATENT DOCUMENTS

| | | | | |
|---|---|---|---|---|
| 2,032,265 | A * | 2/1936 | Dawes | 87/2 |
| 5,067,384 | A * | 11/1991 | Scala | 87/6 |
| 5,671,649 | A * | 9/1997 | Piotrowski et al. | 87/9 |
| 5,899,134 | A * | 5/1999 | Klein et al. | 87/9 |
| 6,412,386 | B1 * | 7/2002 | Tseng | 87/9 |
| 6,622,604 | B1 * | 9/2003 | Chouinard et al. | 87/11 |
| 2005/0240076 | A1 * | 10/2005 | Neisz et al. | 600/30 |

* cited by examiner

*Primary Examiner*—Shaun R Hurley

(57) ABSTRACT

A striped braided element comprising: a first set of members having a common direction of winding, the center axis of said first set of members being axially displaced relative to each other in relation to a common braiding axis; and a second set of members having an opposite direction of winding, the center axis of the second set of members being axially displaced relative to each other in relation to the common braiding axis, the braided element exhibiting a uniform uninterrupted braid pattern and an average uniform distance between the center axis of members having a common direction of winding at a particular circumferential section along the common braiding axis; characterized by having at least one stripe comprising two adjacent members of the same set exhibiting a significantly reduced distance between the center axis of the adjacent members in the particular circumferential section.

29 Claims, 22 Drawing Sheets

STRIPED BRAIDED ELEMENT

CROSS-REFERENCE TO RELATED APPLICATIONS

This application claims priority from U.S. Provisional Patent Application Ser. No. 60/535,493 filed Jan. 12, 2004 entitled "METHOD FOR BRAIDING A STRIPED BRAIDED ELEMENT AND STRIPED BRAIDED ELEMENT FORMED THEREFROM" the entire contents of which are incorporated herein by reference.

FIELD AND BACKGROUND OF THE INVENTION

The present invention relates to braiding methods and braided elements formed therefrom, and more particularly, to a method for braiding a striped braided element and the striped braided element formed therefrom.

The field of braiding, encompassing two-dimensional and three-dimensional braiding methods, devices, and systems, and braided elements formed by implementing thereof, is relatively well developed and documented about, including in the patent literature. Braiding is used in a wide variety of different fields, for example, textiles, electronics, aerospace, and medicine, for performing a variety of different applications, for example, harnessing, shielding, and/or reinforcing, materials and structures, requiring special or high performance properties, characteristics, and behavior.

In its most basic form, the process of braiding is based on converging a plurality of fibers, wires, threads, strings, yarn, or strands, herein, generally referred to as filaments, into a braiding zone which comprises a filament take-up device, as the filaments are supplied, tensioned, and unwound, by a plurality of filament carrier units. Each filament carrier unit comprises operative connections of a filament supply mechanism and a filament tensioning mechanism. The converging unwound filaments are taken up by the filament take-up device and form the two-dimensional or three-dimensional braided element. Each filament carrier unit may be made to supply multiple filaments that are grouped together and thus remain parallel and essentially contiguous throughout the braiding process and in the ultimate braided device. The braided device thus is composed of members, each member comprising either an individual filament or a contiguous group of filaments.

In two-dimensional braiding, the take-up device is ordinarily in the form of a rod, tube, or mandrel, herein, generally referred to as an axial braid configuring element, which is typically coaxial with a braiding axis extending through the braiding zone. The unwound members converging into the braiding zone and toward the braiding axis are braided and configured onto the outer surface of the axial braid configuring element, and form a two-dimensional braided element.

In three-dimensional braiding, the take-up device is ordinarily in the form of a multi-component mechanized device or mechanism, and directly takes up the unwound members as they converge into the braiding zone and form a three-dimensional braided element. In a three-dimensional braiding process, the braided members extend throughout the three-dimensional braided element in three dimensions, and are not limited to extending along the outer surface of an axial braid configuring element.

A commonly used implementation of conventional two-dimensional braiding method is the 'maypole' type machine, schematically illustrated in FIG. 1. Such a machine is commercially available from a number of manufacturers including Steeger USA, Inc., of Spartanburg, S.C., USA, or the Wardwell Braiding Machine Company of Central Falls, R.I., USA. In maypole type braiding machine 5, a plurality of members 14*a*, 14*b* are converged into a braiding zone BZ comprising a take-up device in the form of an axial braid configuring element 16 with a braiding axis BA, as the members 14*a*, 14*b* are supplied, tensioned, and unwound, by a plurality of synchronously configured and moving filament carrier units 10*a*, 10*b* and form a two-dimensional braided element 18 on the outer surface of the axial braid configuring element 16. The element 18 is characterized by at least two sets of helically wound members 14*a*, 14*b* having the braiding axis BA as their common axis. Each member in the set is characterized as having a common direction of winding, with the plurality of members of the set being axially displaced with respect to each other. The sets differ from each other in the direction of winding; with the first set 14*a* being wound in the opposite direction from the second set 14*b*. FIG. 1 is illustrated with 4 filament carrier units of each set, 10*a* and 10*b* respectively, however this is not meant to be limiting in any way.

Each filament carrier unit 10*a*, 10*b* is operatively connected to a gear or rotor type of driving mechanism (not shown), which in turn is operatively connected to a driving mechanism train or assembly (not shown) supported by a platform 17, according to a pre-determined configuration or design.

Braiding is ordinarily accomplished by synchronously rotating a first set of filament carrier units 10*a* (shown in black) in one direction, for example, clockwise, along a first circular serpentine track 20*a* (shown in grey), and a second set of filament carrier units 10*b* (shown in white) in the opposite direction, for example, counterclockwise, along a second circular serpentine track 20*b* (shown in white), periodically intersecting or crossing the first circular serpentine track 20*a*, in order to braid the unwound first set of members 14*a* and second set of members 14*b* as they converge into the braiding zone BZ toward the braiding axis BA and form a two-dimensional braided element 18 on the outer surface of the axial braid configuring element 16.

Two-dimensional braiding devices and machines are well described in patent literature, for example, U.S. Pat. Nos. 1,064,407 and 1,423,587, issued to Wardwell; U.S. Pat. No. 3,783,736, issued to Richardson; U.S. Pat. No. 4,616,553, issued to Nixon; U.S. Pat. No. 5,931,077, issued to DeYoung; and U.S. Pat. No. 5,974,938, issued to Lloyd. The teachings of such published literature and patents are fully incorporated herein by reference. Three-dimensional braiding methods, devices, and systems, are taught about in U.S. Pat. No. 6,439,096, issued to Mungalov et al.; U.S. Pat. No. 6,345,598, issued to Bogdanovich, et al.; U.S. Pat. No. 5,630,349, issued to Farley; and U.S. Pat. No. 4,615,256, issued to Fukata, et al.; the teachings of which are fully incorporated herein by reference.

There is a plethora of prior art teachings of different types of two-dimensional and three-dimensional braided elements, characterized by various types of two-dimensional and three-dimensional braid configurations or patterns of the members, respectively. Two well known prior art types of a two-dimensional braid configuration are: (a) a 'one-over-two' type of two-dimensional braid configuration or pattern, also known as a 'regular' or 'herringbone' pattern, and referred to herein as a 1×2 braid pattern, and (b) a 'one-over-one' two-dimensional braid configuration or pattern, also known as a 'diamond' pattern, and referred to herein as a 1×1 braid pattern.

A two or three dimensional braid pattern is ordinarily characterized by a uniform separation between the center axis of adjacent members in the set of members when measured along the circumference of the braid at any point along the longitudinal braid axis. This uniform separation is equal to the pitch of the braid divided by the number of members rotating in the same direction. It is to be understood by those skilled in the art, that there is no requirement that all filaments in a specific member be identical, nor is it required that all the members of a braid be identical. There is also no requirement that the separation be uniform over the longitudinal length of the braided element. There is therefore a uniform distance between the longitudinal center of each axially displaced member and the adjacent member being wound in the same direction at each circumferential section along the longitudinal braid axis of the braided element.

Exemplary embodiments of each of the above indicated two types, 1×2 and 1×1 braid patterns of a braided element, are illustrated in FIGS. 2A–2C, and are each briefly described immediately following in terms of using the previously described conventional braiding method using a maypole type machine 5 schematically illustrated in FIG. 1.

FIG. 2A is a schematic diagram illustrating an exemplary embodiment of a two-dimensional braided element characterized by a 1×2 braid pattern. In braided element 30 each member, for example, member 32, supplied, tensioned, and unwound, from filament carrier units 10*a* in a first set rotating in one direction, for example, clockwise, along a first circular serpentine track 20*a*, passes over and under two other members, for example members 34' and 34", supplied, tensioned, and unwound, from filament carrier units 10*b* in a second set rotating in the opposite direction, for example, counterclockwise, along a second circular serpentine track 20*b*. As shown in FIG. 2A, the braid pattern, and the distance between the center axis of adjacent members thereof, is uniform for any particular circumferential section along the longitudinal braid axis BA of the braided element 30.

FIG. 2B is a schematic diagram illustrating an exemplary embodiment of a two-dimensional braided element characterized by a 1×1 braid pattern. In braided element 36, each member, for example, member 38, supplied, tensioned, and unwound, from filament carrier units 10*a* in a first set rotating in one direction, for example, clockwise, along a first circular serpentine track 20*a*, passes over and under one other member, for example, member 40, supplied, tensioned, and unwound, from filament carrier units 10*b* in a second set rotating in the opposite direction, for example, counterclockwise, along a second circular serpentine track 20*b*. As shown in FIG. 2B, the braid pattern, and the distance between the center axis of adjacent members thereof, is uniform for any particular circumferential or radial section along the entire longitudinal braid axis BA of the braided element 36.

FIG. 2C is a schematic diagram illustrating an exemplary embodiment of a two-dimensional braided element characterized by a 1×1 bra uniformly comprising multiple adjacently parallel and essentially contiguous filaments. In braided element 42 each member comprising four adjacently parallel and essentially contiguous filaments, for example, member 44 comprising filaments 44*a*, 44*b*, 44*c* and 44*d*, supplied, tensioned, and unwound, from filament carrier units 10*a* in a first set rotating in one direction, for example, clockwise, along a first circular serpentine track 20*a*, passes over and under one other member comprising four adjacently parallel and essentially contiguous filaments, for example, member 46 comprising adjacently parallel and essentially contiguous filaments 46*a*, 46*b*, 46*c* and 46*d*, supplied, tensioned, and unwound, from filament carrier units 10*b* in a second set rotating in the opposite direction, for example, counterclockwise, along a second circular serpentine track 20*b*.

As shown in FIG. 2C, for this 1×1 braid pattern in which each member comprises four adjacently parallel and essentially contiguous filaments, the distance between the center axis of all adjacent members of each set is uniform at each point along the longitudinal axis of the two-dimensional braided element 42, that is, for any circumferential section along the entire longitudinal braid axis BA.

In general, the use of fine wire as a filament in a uniform braid pattern is particularly advantageous in intraluminal medical devices. Unfortunately, such fine wire, in particular fine metallic wire having a cross-section or diameter smaller than approximately 100 μm, is relatively transparent to radiographic visualization. This lack of radio-opacity has led to various solutions and inventions, such as that described in U.S. Pat. No. 6,293,966 and U.S. Pat. No. 5,741,327 both to Frantzen and U.S. Pat. No. 6,503,271 to Duerig et al. Typically, these prior art solutions require the use of an additional material to be added to the intraluminal device, which may not be desirable.

Other proposed solutions include U.S. Pat. No. 6,527,802 to Mayer, which requires the use of a filament comprising a core and a clad, the core comprising a platinum-nickel alloy. Such a wire increases the cost and complexity of the medical device.

A further disadvantage to the prior art uniform braid pattern, particularly as applicable to a fine wire device, is the lack of structural rigidity supplied by the fine wire. One solution for this difficulty is shown in FIG. 2C, in which multiple filaments are combined into a single member. Unfortunately, utilizing multiple contiguous filaments increases the rigidity throughout the device, and does not allow for the possibility of having different combinations of rigidity at different points along the longitudinal axis.

There is thus a long felt need for, and it would be highly advantageous to have a braiding element having improved radio-opacity characteristics. Furthermore, it would be highly advantageous to have a braided element having different structural characteristics, which can be changed at different points along the longitudinal axis of the element.

SUMMARY OF THE INVENTION

Accordingly it is an object of the present invention to overcome the disadvantages of the prior art by supplying improved radio-opacity characteristics of a braided element, which radio-opacity characteristics can be changed at different points along the longitudinal axis of the element. Preferably, such improved radio-opacity characteristics are achieved with minimal effect to the regular braid pattern having specific spacing between the center axes of adjacent members. Further preferably, the improved radio-opacity is achieved in regions wherein minor changes to the spacing between the center axes of adjacent member do not affect the performing characteristic of the braided element. A further object of the present invention is to supply different structural characteristics of a braided element, which structural characteristics can be changed at different points along the longitudinal axis of the element.

In accordance with the present invention there is provided a method for braiding a striped braided element, comprising the steps of: (a) selecting and setting specific braiding process and operating parameters, said parameters comprising a nominal tension value for members of the striped braided element and a braid pattern; (b) operating a braiding device using the braiding process and operating parameters, for converging, in a braiding manner, a plurality of members to produce the striped braided element, the members comprising a first set of members having a common direction of winding and a sequential order, the center axis of each member of the first set of members being axially displaced relative to each other in relation to a common braiding axis, and a second set of members having an opposite common direction of winding and a sequential order, the center axis of each member of the second set of members being axially displaced relative to each other in relation to the common braiding axis, said process and parameters resulting in a braid exhibiting a uniform uninterrupted braid pattern and an average uniform distance between the center axis of members having a common direction of winding at a particular circumferential section along the common braiding axis; (c) controllably decreasing the tension of a first member of the first set; and (d) controllably increasing the tension a second member of the first set, the second member sequentially following the first member; whereby the differences in tension form at least one stripe comprising two adjacent members of the same set exhibiting a significantly reduced distance between the center axis of the two adjacent members in the particular circumferential section.

In one preferred embodiment, the two adjacent members are substantially separated by the width of a member of the second set. In another preferred embodiment members exhibiting a significantly reduced distance, comprise the first member and the member of the first set sequentially preceding the first member. In yet another preferred embodiment the braiding device is operated to produce a stripe extending for at least one complete winding in a clockwise or counter-clockwise direction. In yet another preferred embodiment the braiding device is operated to produce a stripe extending for less than a complete winding in a clockwise or counter-clockwise direction.

Preferably, the braid pattern is a 1×1 braid pattern or a 1×2 braid pattern.

In one exemplary embodiment the braiding device is operated to produce a plurality of stripes, at least one stripe extending for at least one complete winding in a clockwise or counter-clockwise direction. In another exemplary embodiment, the braiding device is operated to produce a plurality of stripes, at least one stripe extending for less than a complete winding in a clockwise or counter-clockwise direction.

In yet another preferred embodiment, the braiding device is operated to produce at least one stripe each in a clockwise and a counter-clockwise direction. In one further preferred embodiment the stripes are disposed in a same pair of radial planes, and in another further preferred embodiment the stripes cross.

Preferably, the decreased tension comprises less than 70% of the nominal tension value, and preferably the increased tension comprises greater than 150% of the nominal tension value. In one embodiment the increased tension is accomplished by supplementing weights, and in another embodiment the decreased tension is accomplished by removing weights. Further preferably the increased and decreased tension is accomplished cyclically.

The invention also provides for a striped braided element comprising: a first set of members having a common direction of winding, the center axis of the first set of members being axially displaced relative to each other in relation to a common braiding axis; and a second set of members having an opposite direction of winding, the center axis of the second set of members being axially displaced relative to each other in relation to the common braiding axis, the braided element exhibiting a uniform uninterrupted braid pattern and an average uniform distance between the center axis of members having a common direction of winding at a particular circumferential section along the common braiding axis; characterized by having at least one stripe comprising two adjacent members of the same set exhibiting a significantly reduced distance between the center axis of the adjacent members in the particular circumferential section.

In a preferred embodiment the two adjacent members are substantially separated by the width of a member of the second set. In another preferred embodiment the stripe extends for at least one complete winding in a clockwise or counter-clockwise direction. In yet another preferred embodiment the stripe extends for less than one complete winding in a clockwise or counter-clockwise direction.

In an exemplary embodiment the braid pattern is a 1×1 braid pattern or a 1×2 braid pattern.

In a preferred embodiment the striped braided element comprises a plurality of stripes, a first stripe extending in a clockwise direction and a second stripe extending in a counter-clockwise direction. In one further preferred embodiment at least one of the first and second stripes extend for less than a complete winding. In another further preferred embodiment at least one of said first and second stripes extend for at least one a complete winding. In yet another further preferred embodiment the first and second stripe are disposed in a same pair of radial planes.

Other features and advantages of the present invention will become apparent from the following drawings and description.

BRIEF DESCRIPTION OF THE DRAWINGS

For a better understanding of the invention with regard to the embodiments thereof, reference is made to the accompanying drawings, in which like numerals designate corresponding sections or elements throughout. With specific reference now to the drawings in detail, it is stressed that the particulars shown are by way of example and for purposes of illustrative description of the preferred embodiments of the present invention only, and are presented in the cause of providing what is believed to be the most useful and readily understood description of the principles and conceptual aspects of the present invention. In this regard, no attempt is made to show structural details of the present invention in more detail than is necessary for a fundamental understanding of the invention, the description taken with the drawings making apparent to those skilled in the art how the several forms of the invention may be embodied in practice.

DESCRIPTION OF THE PREFERRED EMBODIMENTS

Figure 1:
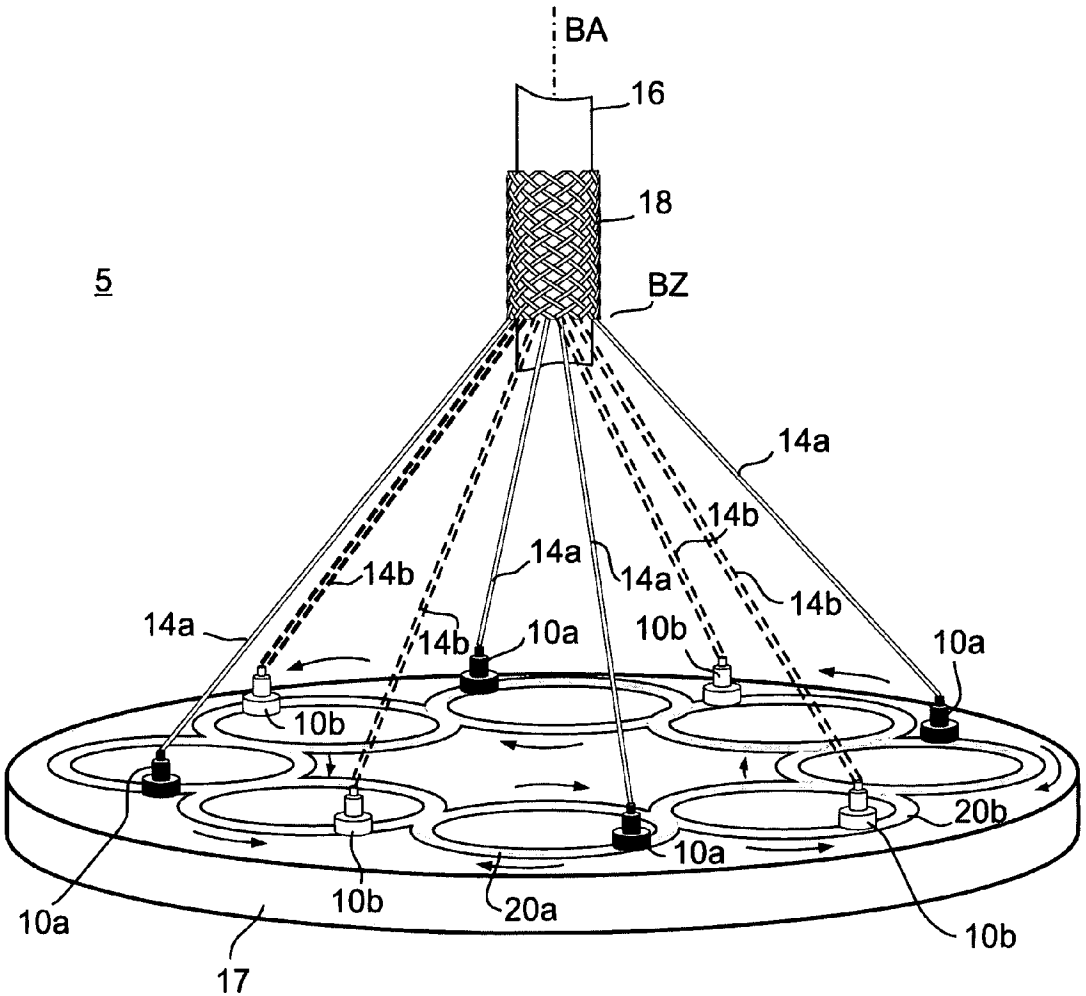
FIG. 1 (prior art)
FIG. 1 (prior art) is a high level diagram of a conventional maypole type braiding machine.
Figure 2A:
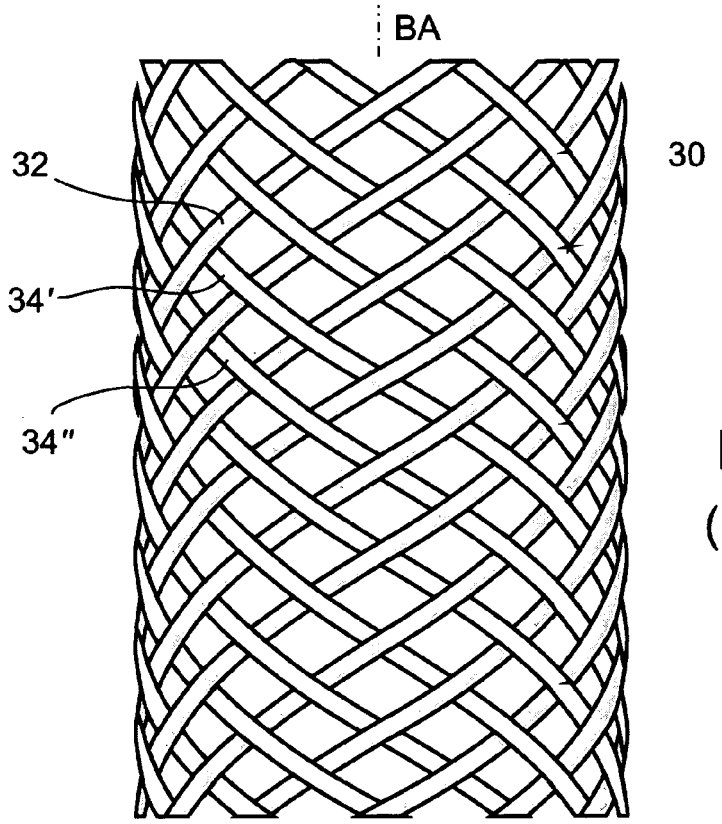
FIG. 2A (prior art)
FIG. 2A (prior art) is a schematic diagram illustrating a braided element characterized by a one-over-two (1×2) braid pattern.
Figure 2B:
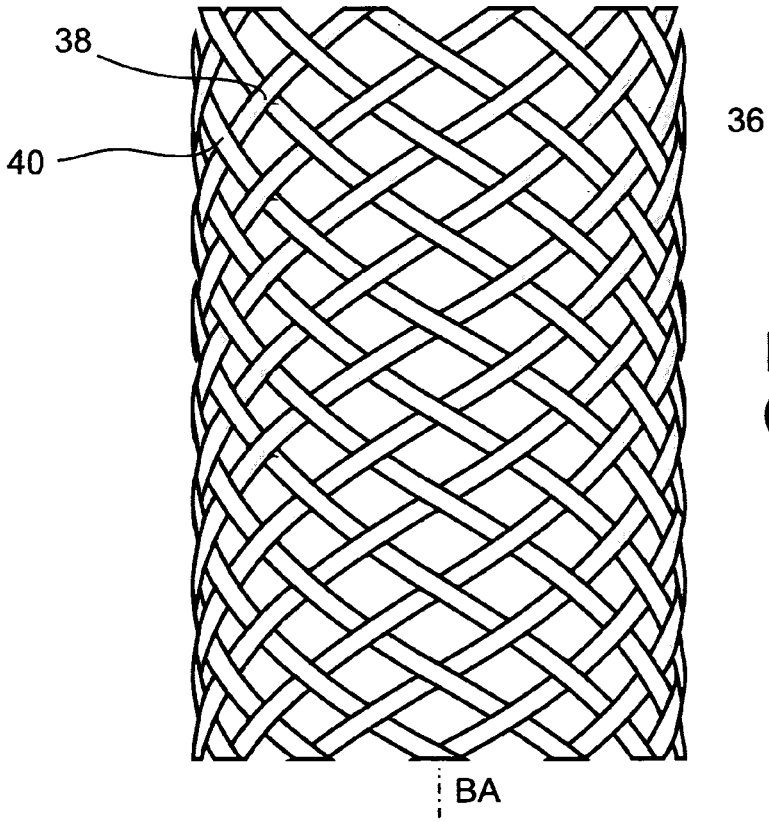
FIG. 2B (prior art)
FIG. 2B (prior art) is a schematic diagram illustrating a braided element characterized by a one-over-one (1×1) braid pattern.
Figure 2C:
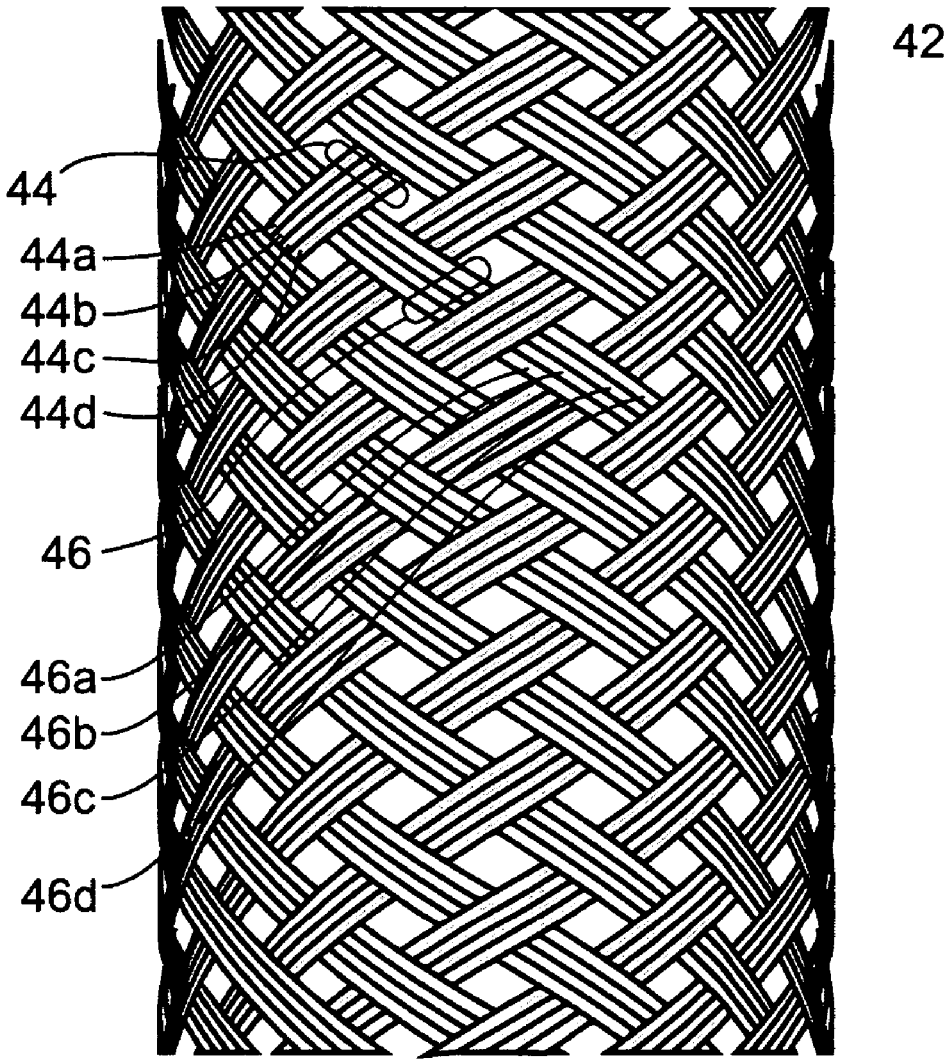
FIG. 2C (prior art)
FIG. 2C (prior art) is a schematic diagram illustrating a braided element characterized by a one-over-one (1×1) braid pattern of members, with each member comprising four filaments.

The present invention provides an innovative differential filament tensioning procedure, for controllably and differentially adjusting tensions of filaments unwinding from filament carrier units of a braiding device, in a braiding process, for forming a striped braided element. The present invention also provides for a striped braided element comprises two sets of helically wound members around a common braiding axis, the members of each set being of an equal number, the members of each set having a common direction of winding but being axially displaced relative to each other, with a first set being wound in a first direction and a second set being wound in an opposing direction having an interrupted uniform braid pattern, characterized by at least one stripe in which the center axis of at least two adjacent helically wound members are in closer proximity than the average of the center axis of the remaining members of the set in at least one region of the striped braided element. The present invention is applicable to, and implemented by using, different types of two-dimensional or three-dimensional braiding techniques, devices, and systems.

Typically, the center axis of at least two adjacent helically wound members of the set are separated by a distance approximately equal to width of a member of the opposite set being crossed in the braiding pattern.

The present invention exhibits improved radio-opacity characteristics that can be changed at different points along the longitudinal axis of the element. Furthermore, in a preferred embodiment the present invention results in braided element having improved structural characteristics that can be changed at different points along the longitudinal axis of the element.

As a specific non-limiting example of a braided device benefiting by improved radio-opacity characteristics according to the principles of the present invention, an intraluminal braided device comprising individual members of a thin metallic wire on the order of 60 microns will not be easily observable by standard commercially available fluoroscopic equipment. A striped braid element, in accordance with the teaching of the present invention, exhibiting a stripe of two adjacent members being in close proximity will present a combined width of approximately 180 microns at a crossing point. This combined width will exhibit an increased radio-opacity, thus improving the ability to ensure proper placement of the intraluminal braided element.

The invention is of further importance with regard to designing and making two-dimensional or three-dimensional intraluminal braided elements having optimum structural (geometrical and mechanical) rigidity and/or stability. By selectively forming and integrating into at least one pre-determined or pre-selected region of the geometry of an intraluminal braided element a pre-determined number of stripes, exhibiting geometrical properties and characteristics, and optionally, physicochemical, properties, characteristics, and behavior, whereby stripe members singly, in combination, or in synergistic combination, exhibit enhanced structural (geometrical and mechanical) rigidity and/or stability properties, characteristics, and behavior, different from those of non-stripe members of the intraluminal braided element, the customized stripes either provide or improve structural (geometrical and mechanical) rigidity and/or stability of the intraluminal braided element, translating to optimum therapeutic performance of the intraluminal braided element.

It is to be understood that the present invention is not limited in its application to the details of the order, sequence, and number, of steps of operation or implementation of the braiding method, or to the details of type, composition, construction, arrangement, order, and number, of the components and elements of the braided element formed therefrom, set forth in the following description and accompanying drawings. For example, the following description and accompanying drawings, mostly relate to a two-dimensional striped braiding technique and a two-dimensional striped braided element formed therefrom, using a maypole type, two-dimensional braiding machine, in exemplary embodiments of the invention, in order to illustrate implementation of the present invention. It is to be fully understood that the present invention is also applicable to other braiding type devices and machines, including but not limited to non-maypole type two dimensional machines and three-dimensional braiding techniques, devices, and systems, implemented for forming three-dimensional striped braided elements therefrom.

It is also to be understood that unless otherwise defined, all technical and scientific words, terms, and/or phrases, used herein have either the identical or similar meaning as commonly understood by one of ordinary skill in the art to which this invention belongs. Phraseology, terminology, and notation, employed herein are for the purpose of description and should not be regarded as limiting. Additionally, as used herein, the term "about" refers to ±10% of the associated value.

Figure 3:
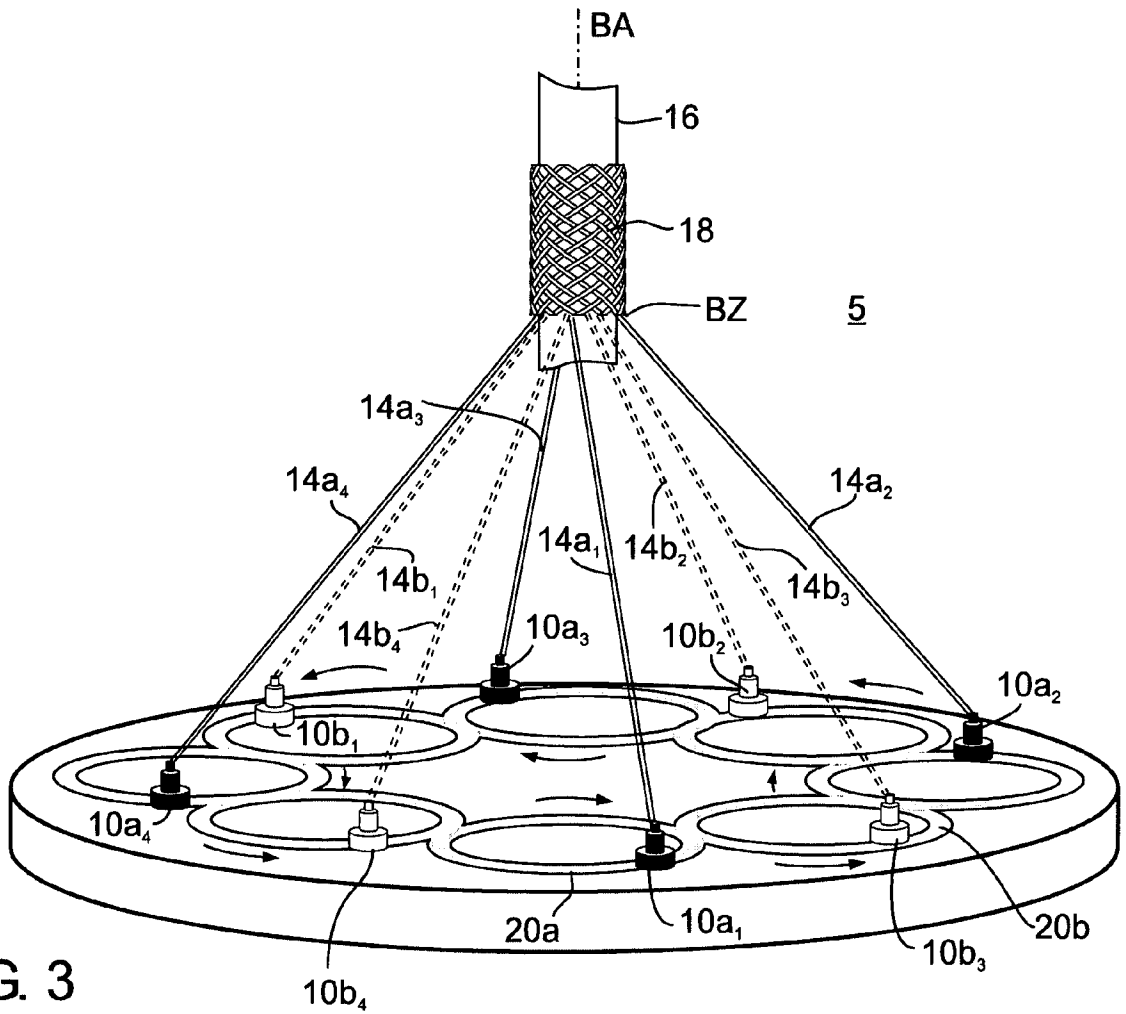
FIG. 3 is a high level diagram of a maypole type braiding machine, applicable for implementing the present invention.

FIG. 3 illustrates a maypole type braiding machine 5 which is in all respects similar to that shown in FIG. 1, with the exception that the filament carrier units 10*a* and 10*b*, respectively, and their associated members 14*a* and 14*b* respectively, are individually labeled for ease of identification. Only four filament carrier units 10*a*, namely filament carrier units 10*a*1, 10*a*2, 10*a*3 and 10*a*4 are shown for clarity, with braid members 14*a*1, 14*a*2, 14*a*3 and 14*a*4 being unwound from each of the above filament carrier units, respectively, towards braiding zone BZ. Similarly only four filament carrier units 10*b*, namely filament carrier units 10*b*1, 10*b*2, 10*b*3 and 10*b*4 are shown for clarity, with braid members 14*b*1, 14*b*2, 14*b*3 and 14*b*4 being unwound from each of the above filament carrier units, respectively, towards braiding zone BZ. This is not meant to be limiting in any way, and any number of filament carrier units 10*a* and 10*b* can be utilized in braiding machine 5 without exceeding the scope of the invention.

The inventors have noted that if one filament carrier unit is missing, or no filaments or members are loaded in its location, the members before and after the missing member will tend to join. For example, operating braiding machine 5 of FIG. 3 to produce a 1×1 braid pattern, with no filament in location 10*b*2, will result in members 14*b*1 and 14*b*3 exhibiting a significantly reduced distance between the center axis of members 14*b*1 and 14*b*3 as compared to distance between the balance of the members 14*a*, 14*b*. Having two adjacent members with significantly reduced distance between the center axis of those members will tend to improve the radio-opacity of the braided device, however this solution is undesirable because the missing filament reduces the total number of members in the braid pattern, with a resulting loss of structural strength. Furthermore, the overall braid pattern is interrupted, due to the missing braid member. The structural integrity of the overall braided devices is negatively impacted by the interruption of the continuous braid pattern. Furthermore it is not possible to reliably control the placement of the significantly reduced distance, and in particular it is not possible to controllably begin and end the area of significantly reduced distance.

Figure 4A:
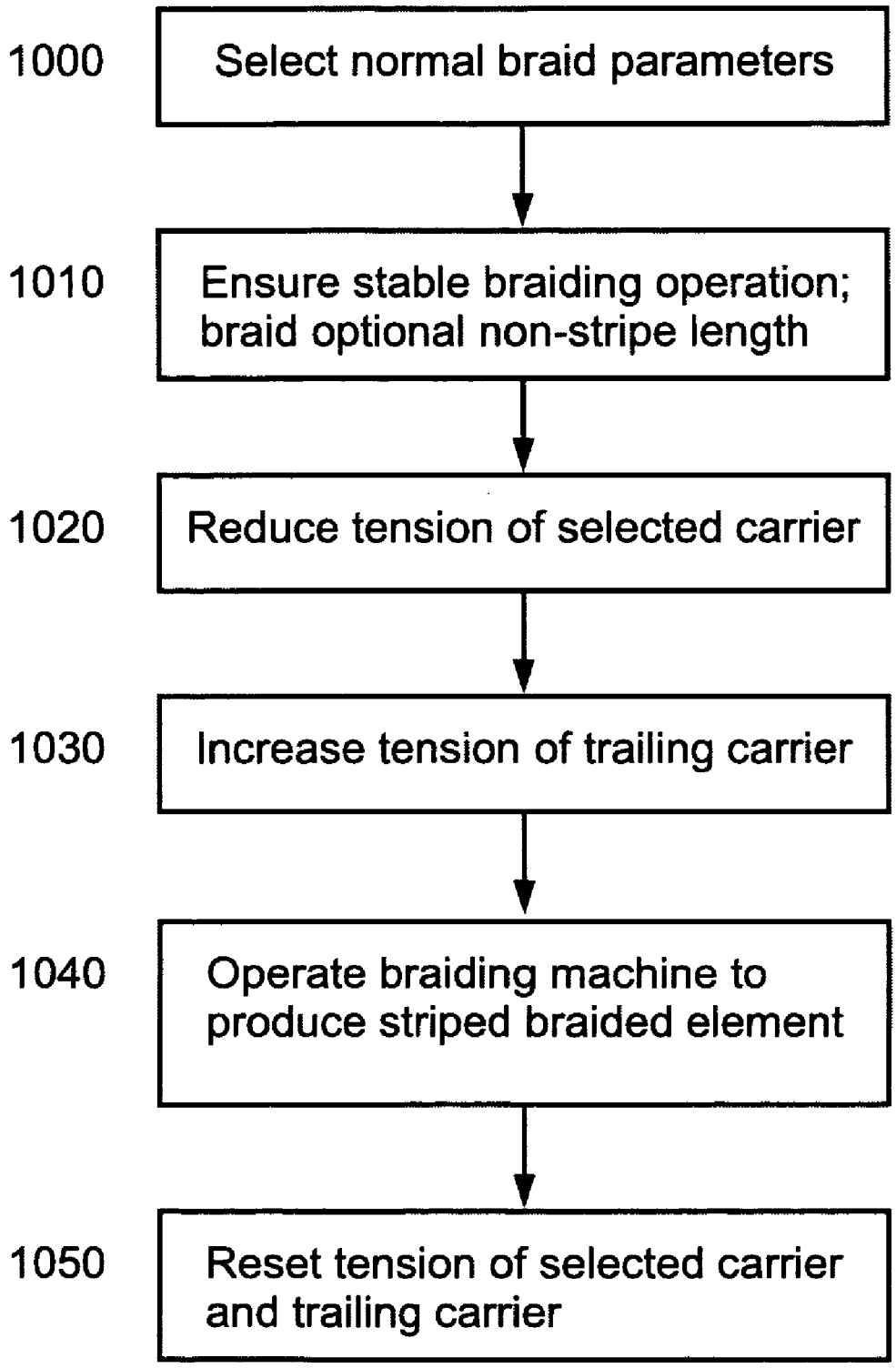
FIG. 4A is a high level flow chart of a first embodiment of the method of striped braiding according to the principles of the present invention.

FIG. 4*a* illustrates the steps of a first embodiment of the striped braiding method, according to the principles of the present invention. In step 1000 specific braiding operating parameters are selected, including but not limited to, type of filament to be braided, number of filament carrier units 10*a*, 10*b* number of filaments per member 14*a*, 14*b*, braiding angle or pitch, braiding speed and filament tension. The selection and implementation of operating parameters are well known to those skilled in the art. In an exemplary embodiment utilizing a 50 micron diameter wire, filament tension is set to about 1.5 Newtons with a horn gear braiding speed of approximately 75 RPM.

In step 1010 braiding machine 5 is operated to achieve a stable braiding point. After a stable braiding point has been achieved, optionally an initial non-striped braiding length is manufactured. Achieving a stable braiding point is accomplished solely for the purpose of ensuring stable operation, and is to be considered optional depending on the needs of the operator. Braiding of an initial non-striped braiding length is optional and is based on the desired location and length of the stripe in the overall braided element, and depends solely on the needs of the operator and the desired striped braided element 18.

In step 1020 tension in filament carrier unit 10*b*2 of FIG. 3 is reduced to a lower tension than selected in step 1000. In an exemplary embodiment the tension is set to less than 70% of the tension selected in step 1000, in a non-limiting example 50% of the tension selected in step 1000.

In step 1030 tension in filament carrier unit 10*b*3 of FIG. 3 is raised to a higher tension than selected in step 1000. In an exemplary embodiment the tension is set to greater than 150% of the tension selected in step 1000, in a non-limiting example 200% of the tension selected in step 1000. It is to be noted that filament carrier unit 10*b*3 belongs to the same set of filament carrier units as filament carrier unit 10*b*2 chosen in step 1020 and trails or immediately follows filament carrier unit 10*b*2 around the circular serpentine track 20*b*.

In step 1040 braiding machine 5 is operated as known to those skilled in the art to produce a length of striped braided element as desired. The striped braided element is defined by the center of the axis of member 14*b*2 being in closer proximity to the center of the axis of member 14*b*1 than the average of the distance between the centers of the axis of the other members of the braided element. In a preferred embodiment, members 14*b*2 and 14*b*1 are separated approximately by the thickness of members 14*a* as members 14*a* cross over and under members 14*b*1 and 14*b*2 in the regular braid pattern. After an appropriate length of striped braided element has been produced, in step 1050 the tension supplied by filament carrier unit 10*b*2 and filament carrier unit 10*b*3 are returned to the initial tension setting selected in step 1000. Further operation thereafter of braiding machine 5 will produce a non-striped portion of braided element 18, in which all members of the set exhibit a uniform distance between the center axis of adjacent members for any particular circumferential section along the longitudinal braid axis of braided element 18.

Figure 4B:
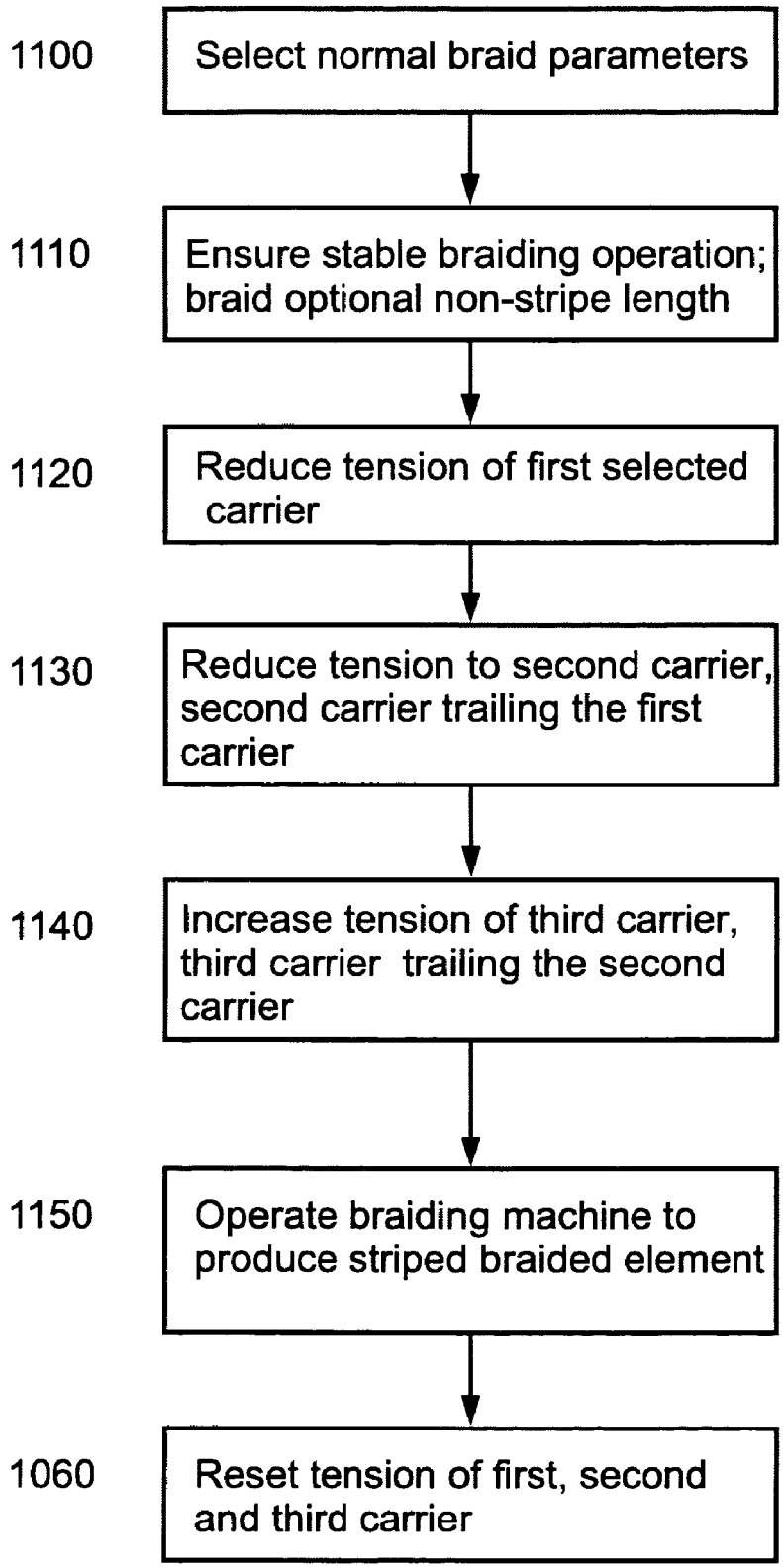
FIG. 4B is a high level flow chart of a second embodiment of the method of striped braiding according to the principles of the present invention.

FIG. 4*b* illustrates the steps of a second embodiment of the generalized striped braiding method, according to the principles of the present invention. In step 1100 specific braiding operating parameters are selected, including but not limited to, type of filament to be braided, number of filament carrier units 10*a*, 10*b*, number of filaments per member 14*a*, 14*b*, braiding angle or pitch, braiding speed and filament tension. The selection and implementation of operating parameters are well known to those skilled in the art. In an exemplary embodiment utilizing a 50 micron diameter wire, filament tension is set to about 1.5 Newton with a braiding speed of approximately 75 RPM.

In step 1110 braiding machine 5 is operated to achieve a stable braiding point. After a stable braiding point has been achieved, optionally, an initial non-striped braiding length is manufactured. Achieving a stable braiding point is accomplished solely for the purpose of ensuring stable operation, and is to be considered optional depending on the needs of the operator. Braiding of an initial non-striped braiding length is optional and is based on the desired location and length of the stripe in the overall braided element, and depends solely on the needs of the operator and the desired striped braided element 18.

In step 1120 tension of first filament carrier unit 10*b*1 is reduced to a lower tension than selected in step 1100. In an exemplary embodiment tension of first filament carrier unit 10*b*1 is set to less than 70% of the tension selected in step 1100, in a non-limiting example 50% of the tension selected in step 1100.

In step 1130 tension of second filament carrier unit 10*b*2 is reduced to a lower tension than the tension selected in step 1100. In an exemplary embodiment tension of second filament carrier unit 10*b*2 is set to the tension selected in step 1100, and is identical with the tension set for first filament carrier unit 10*b*1 in step 1120. It is to be noted that second filament carrier unit 10*b*2 trails and immediately follows first filament carrier unit 10*b*1 around circular serpentine track 20*b*.

In step 1140 tension of third filament carrier unit 10*b*3 is raised to a higher tension than the tension selected in step 1100. In an exemplary embodiment the tension is set to greater than 150% of the tension selected in step 1100, in a non-limiting example 200% of the tension selected in step 1100. It is to be noted that third filament carrier unit 10*b*3 trails and immediately follows second filament carrier unit 10*b*2 around circular serpentine track 20*b*.

In step 1150 braiding machine 5 is operated to produce a length of striped braided element as desired. The striped braided element is defined by the center of the axis of member 14*b*2 being in closer proximity to the center of the axis of member 14*b*1 than the average of the distance between the centers of the axis of the other members of the braided element. In a preferred embodiment, members 14*b*2 and 14*b*1 are separated approximately by the thickness of members 14*a* as members 14*a* cross over and under members 14*b*1 and 14*b*2 in the regular braid pattern.

After an appropriate length of striped braided element has been produced in step 1160 tension of first, second and third filament carrier units 10*b*1, 10*b*2 and 10*b*3 are returned to the initial tension setting selected in step 1100. Further operation thereafter of braiding machine 5 will produce a non-striped portion of braided element 18, in which all members of the set exhibit a uniform distance between the center axis of adjacent members of the set for any particular circumferential section along the longitudinal braid axis of striped braided element 18.

Figure 5A:
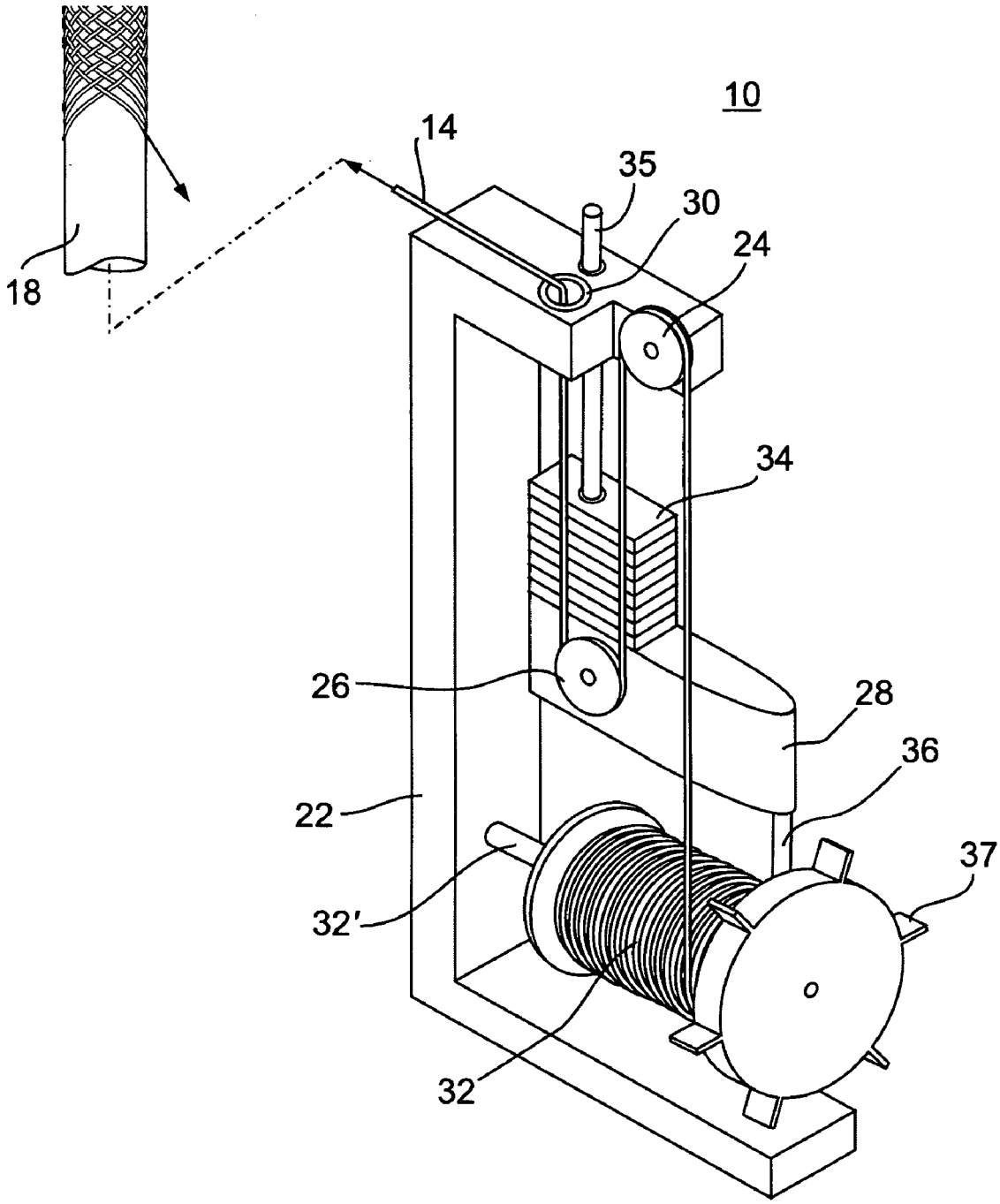
FIG. 5A is a schematic diagram illustrating an exemplary embodiment of a filament carrier unit including a gravitational type of filament tensioning mechanism, useful for implementing the principles of the present invention.

FIG. 5A is a schematic diagram illustrating an exemplary embodiment of a filament carrier unit 10 including a novel type of filament tensioning mechanism, useful for implementing the striped braiding method of the present invention. Filament carrier unit 10, includes a vertically-extending mounting member 22 rotatably mounting the respective filament spool 32 for rotation about a horizontal axis. Spool 32 could be mounted to rotate with respect to its shaft 32' or could be fixed to its shaft and both rotated with respect to mounting member 22. Filament carrier unit 10 is illustrated with member 14 comprising a single filament, hereinafter filament 14', however this is not meant to be limiting in any way. Filament carrier unit 10 could combine multiple filament spools 32, or multiple filament carrier units 10 could be combined on serpentine circular track 20*a* or 20*b*. Thus, member 14 can comprise a single filament 14' or multiple filaments 14', without exceeding the scope of the invention.

In the embodiment illustrated in FIG. 5A, each carrier mounting member 22 mounts an upper roller 24 and a lower roller 26 above the spool 32, each roller being rotatably mounted about an axis parallel to the spool axis. The upper roller 24 is rotatably mounted on the carrier mounting member 22; whereas the lower roller 26 is rotatably mounted on a movable mounting member 28 which is vertically displaceable with respect to roller 24 and mounting member 22. Each filament 14' is fed from its respective spool 32 over the upper roller 24, and under the lower, vertically-displaceable roller 26, and through an upper eyelet 30 to the braiding zone BZ of FIG. 3.

One of the problems in braiding machines of this type is the need for applying the appropriate tension to filaments 14' of member 14 so as not to break or deform filament 14' by an unduly large tension, or to produce a sag in filament 14' of member 14, particularly the portion between the upper eyelet 30 and the braiding zone BZ, which may cause entanglement with other members 14 as their respective carriers 10 are rotated about the braiding axis BA. Braiding machine 5 includes a novel arrangement for applying the appropriate tension to the filaments 14' in which one or more balanced weights 34 carried by the movable mounting member 28 supply a fixed tension. The vertical displacement of mounting member 28, and thereby of the lower roller 26, is guided by a rod 35 movable within an opening in the upper section of roller mounting member 22.

FIG. 5A further includes the vertically-displaceable mounting member 28 for the lower roller 26 as provided with a depending finger 36 movable within recesses defined by a retainer member 37 fixed to the spool shaft 32' to restrain the spool shaft from free rotation. Use of one or more weights 34, which can be easily removed or supplemented, simplifies the task of changing the tension supplied to filaments 14'. The above description of a filament carrier unit 10 including a novel type of filament tensioning mechanism is meant to be illustrative only, and is not meant to be limiting in any way. Other methods and means of adjusting tension, as is known to those skilled in the art, may be utilized without exceeding the scope of the invention.

Figure 5B:
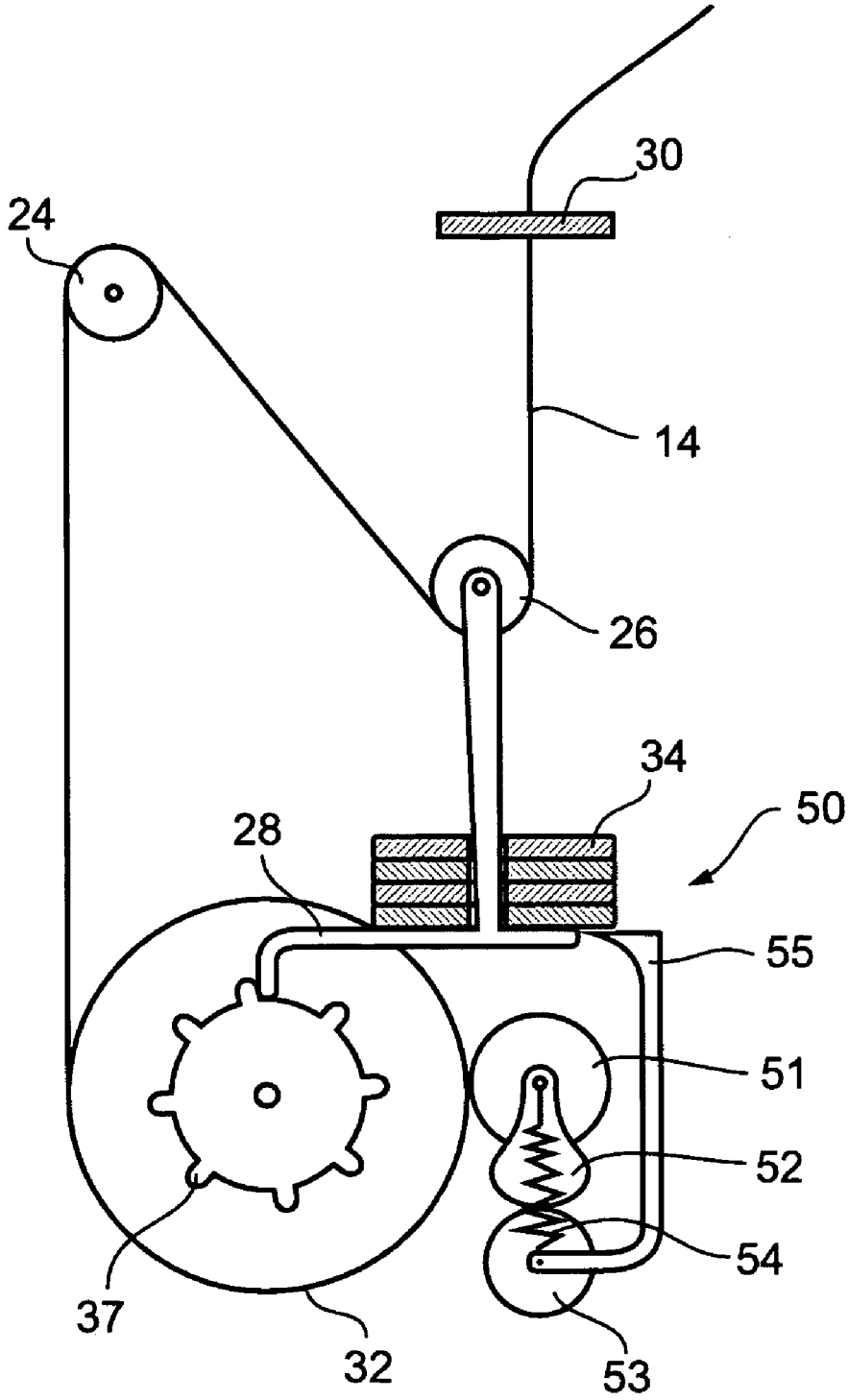
FIG. 5B is a schematic diagram illustrating an exemplary embodiment of a filament carrier unit including a control mechanism, useful for implementing the principles of the present invention

FIG. 5B illustrates a tensioning arrangement similar to that of FIG. 5A also utilizing weights 34, but including a control mechanism, generally designated 50, for varying the force applied by the weights in a closely-controlled manner to produce a variable (rather than uniform), precisely-controlled tension force to the respective filament.

Thus, control mechanism 50 illustrated in FIG. 5B includes a wheel 51, driven by spool 32, rotating a cam 52 engaged by a cam follower 53 which is urged against the outer surface of cam 52 by a spring 54, such that the cam follower 53 will move vertically according to the outer surface of cam 52. A weight-changer member 55 is coupled to cam follower 53 so that member 55 moves vertically according to the outer surface of cam 52 to engage weights 34 such as to vary the force applied by the weights for tensioning filament 14. Preferably, weights 34 are engaged at a point so as not to affect its balanced condition. It will thus be seen that by providing cam 52 with the appropriate outer surface, the force applied by weights 34 to tension the filament 14' can be varied in a closely-controlled manner as desired. Such a control mechanism, or another control mechanism as is known to those skilled in the art, may be advantageously designed to cyclically adjust the tension applied to filament 14' thus producing an appropriate length of a cyclically striped braided element.

Figure 6:
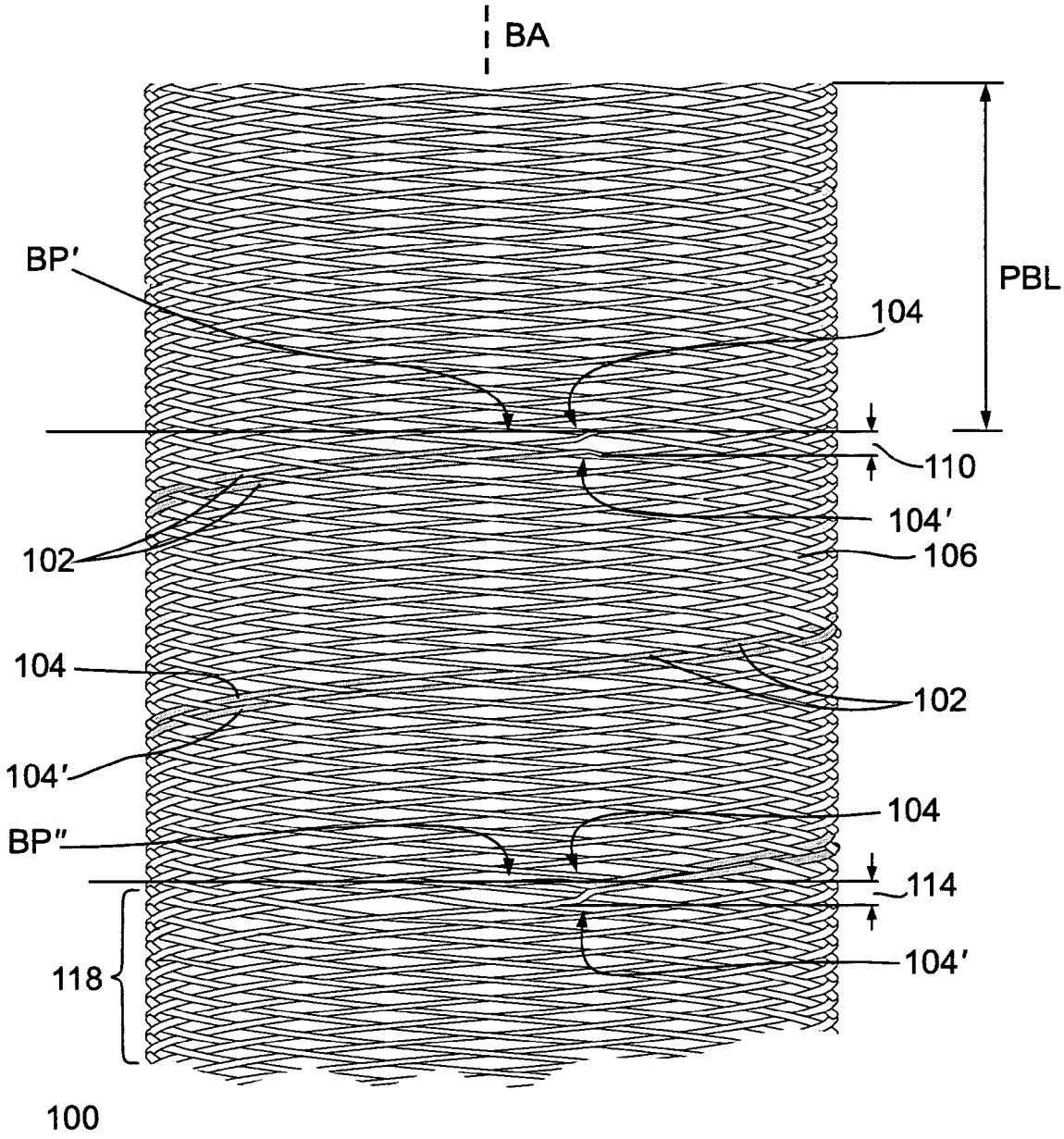
FIG. 6 is a schematic diagram illustrating an exemplary embodiment of a striped braided element, characterized by a one-over-one (1×1) braid pattern including a single stripe extending, for a plurality of two complete windings, in a clockwise direction about the braiding axis in accordance with the principles of the present invention.

FIG. 6 illustrates an exemplary embodiment of a striped braided element 100 in accordance with the principles of the present invention, characterized by a 1×1 braid pattern including a single stripe 102 (shown highlighted in dark gray) of two closely spaced members 104 and 104' extending for a plurality of two complete windings, in a clockwise direction, about the braiding axis BA.

Striped braided element 100 is formed by implementing the striped braiding method of the present invention. During the first or initial stage of the braiding process, represented by step 1010 of FIG. 4*a* and step 1110 of FIG. 4*b* respectively, a stable braiding point is established, and thereafter pre-stripe braiding length PBL, wherein no stripe is desired, is braided. In pre-stripe braiding length PBL a characteristic uniform average distance exists between the center axis of members having a common direction of winding at any particular circumferential section along the braiding axis BA.

The braid is illustrated as being uniform along the length PBL, however this is not meant to be limiting in any way. The braid may be of any shape, including but not limited to being conically shaped, or of a varying pitch along the longitudinal braid axis BA, all without exceeding the scope of the invention.

After implementation of steps 1020 and 1030 of FIG. 4*a* or steps 1120, 1130 and 1140 of FIG. 4*b* respectively, step 1040 of FIG. 4*a* or step 1150 of FIG. 4*b* is implemented. After a member joining braiding length, indicated in FIG. 6 by 110, which in an exemplary embodiment comprises 0.1 to 0.3 mm, stripe 102 is generated, stripe 102 being defined by the center axis of adjacent members 104 and 104' being in closer proximity than the average distance exhibited by the remaining members of the set. Preferably, members 104 and 104' are separated substantially the cross-section or diameter of member 106 being wound in the opposing direction. Stripe 102 extends for two complete windings, in a clockwise direction about the braiding axis corresponding to the length along the braiding axis between points BP' and BP". In an exemplary embodiment, for the length of stripe 102, all members of the set of stripe 102 not participating in stripe 102, exhibit an average distance between the center axis of adjacent members slightly larger than the distance exhibited between the center axis of adjacent members outside of the stripe area, such as in area PBL.

Step 1050 of FIG. 4*a* or step 1160 of FIG. 4*b* is implemented at point BP" associated with member positions located just before the desired end of the stripe, wherein members 104 and 104' are to resume the normal distance between the center axis of adjacent members exhibited by all members of the set. After a relatively short member separating braiding length, indicated in FIG. 8 by 114, which in an exemplary embodiment comprises 0.1 to 0.3 mm, the braid of area 118 exhibits a uniform distance between the center axis of adjacent members of the set at any particular circumferential section along the braiding axis BA.

Figure 7:
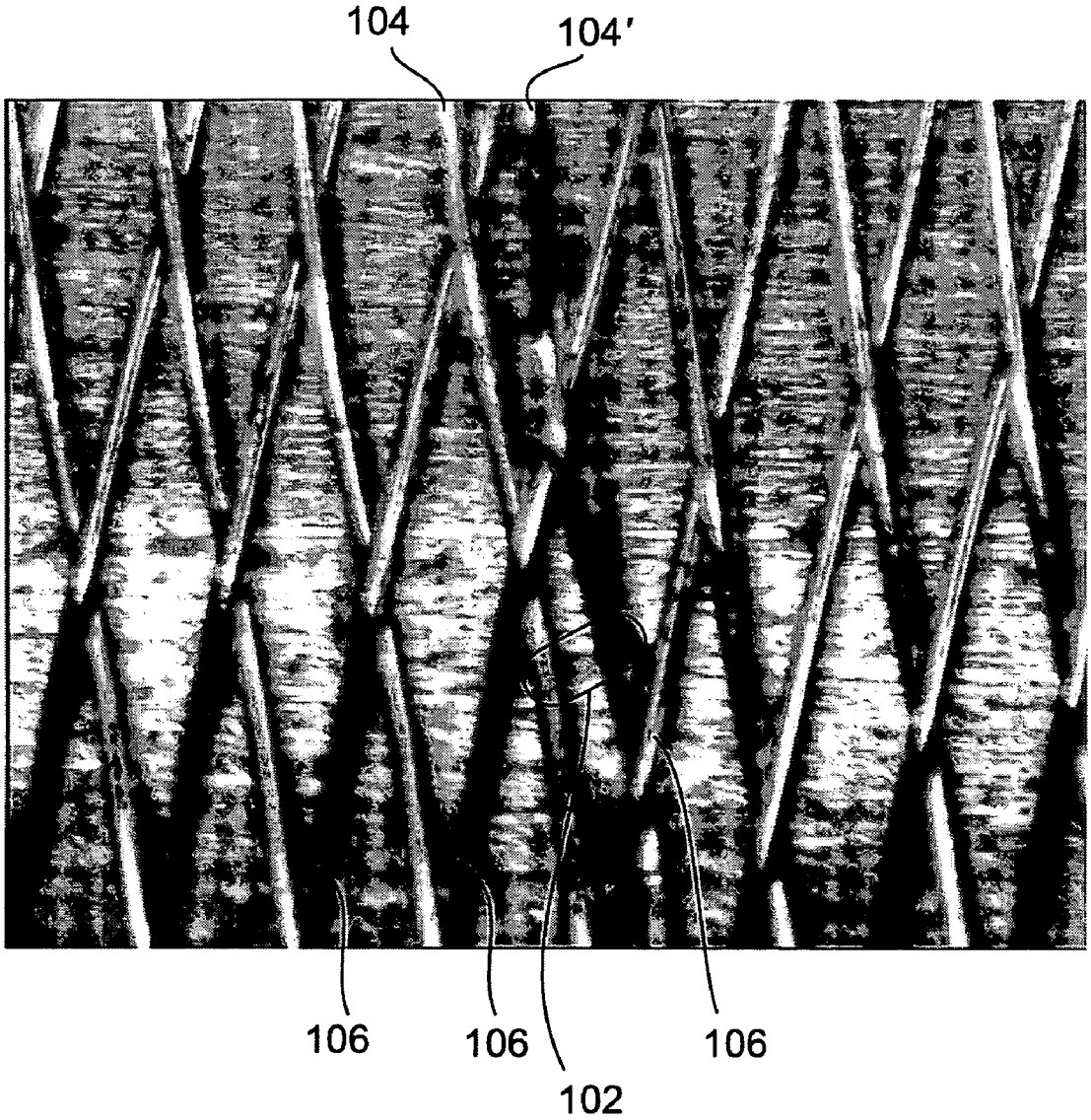
FIG. 7 is an illustration of a portion of a braid implemented according to the principles of the present invention.

FIG. 7 is an illustration of a portion of a braid implemented according to the principles of the present invention wherein members 104 and 104' form stripe 102. The center axis of adjacent members 104 and 104' are in close proximity to each other along the braid length. Members 104 and 104' are separated substantially by the cross-section or diameter of members 106, representing members of the set wound in the opposing direction. All other braid members are shown exhibiting a uniform distance at each point along the braid length.

FIGS. 8A through 13B are schematic diagrams each illustrating an exemplary embodiment of a striped braided element, characterized by a 1×2 braid pattern or a 1×1 braid pattern including at least a single stripe according to the teaching of the present invention. In these figures, the portion of the braiding axis BA located along the beginning (starting) region of a striped braided element is indicated as BAb, and the portion of the braiding axis BA located along the ending (finishing) region of a striped braided element is indicated as BAe. Also, in these figures, the beginning (starting) region, the middle (intermediate) region, and the ending (finishing) region, of a striped braided element, are indicated as br, mr, and er, respectively.

In each stripe in each exemplary embodiment of a striped braided element illustrated in these figures, it is shown that the center axis of two adjacent members of a set of members having a common direction of winding are closely spaced, thus breaking with the uniformity of the overall braid pattern.

Figure 8A:
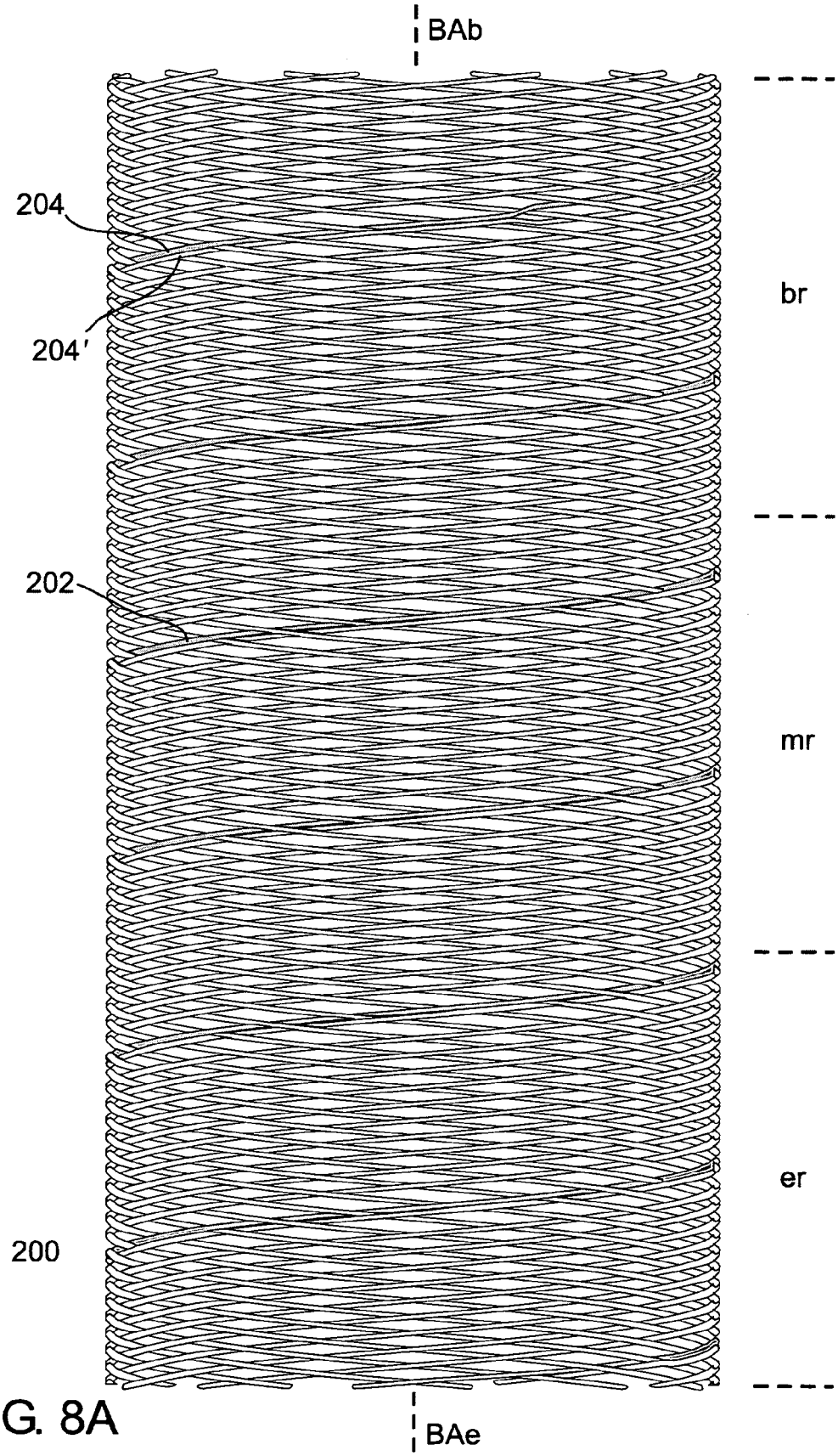
FIGS. 8A and 8B are schematic diagrams each illustrating an exemplary embodiment of a striped braided element, characterized by a one-over-two (1×2) (FIG. 8A) or a one-over-one (1×1) (FIG. 8B) braid pattern including a single stripe extending for a plurality of complete windings in a clockwise direction about the braiding axis of the striped braided element in accordance with the principles of the present invention.
Figure 8B:
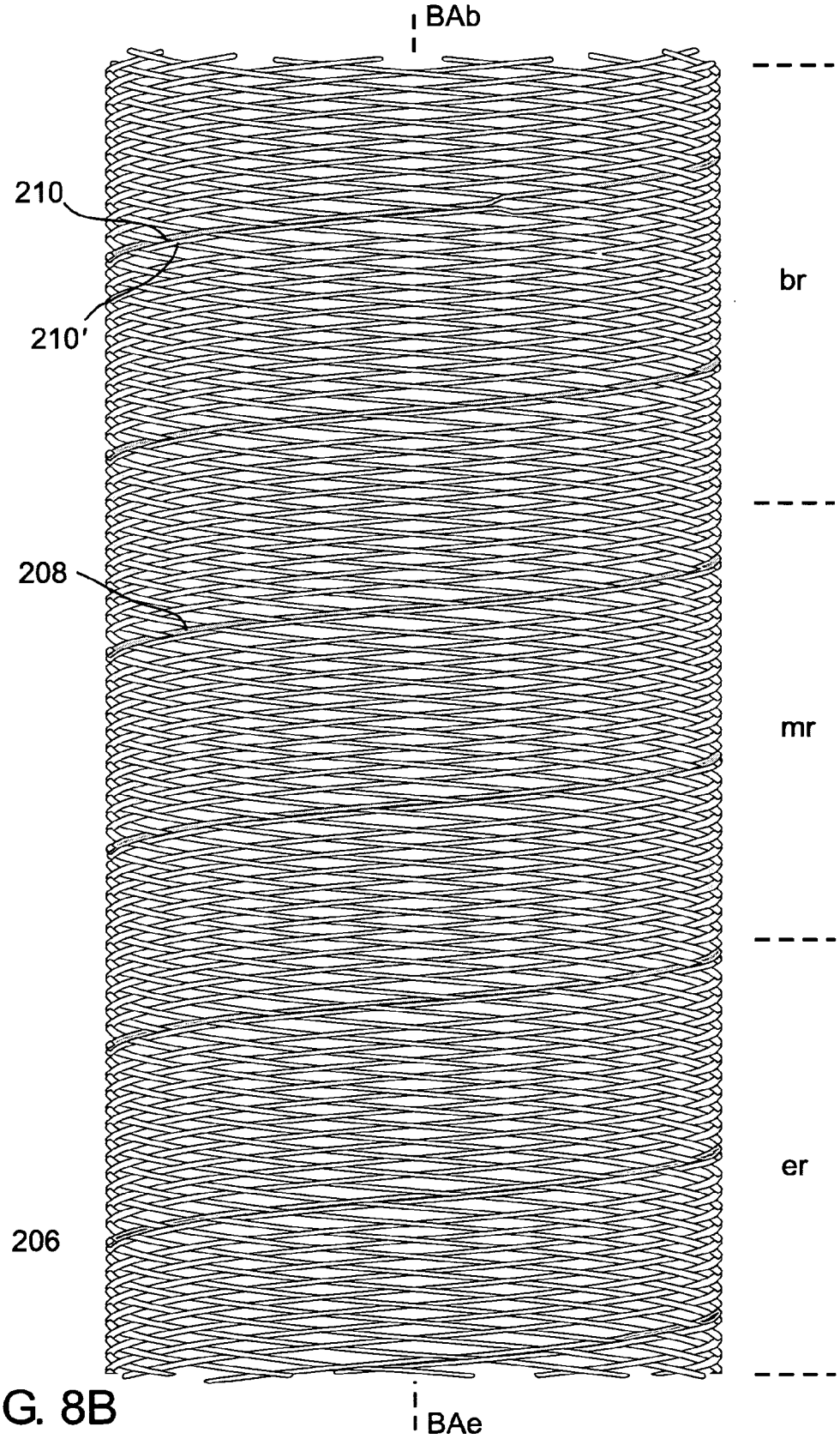

FIGS. 8A and 8B are schematic diagrams each illustrating an exemplary embodiment of a striped braided element 200 and 206, respectively, characterized by a 1×2 (FIG. 8A) or a 1×1 (FIG. 8B) braid pattern including a single stripe 202 and 208, respectively, formed by implementing the striped braiding method of the present invention.

In each striped braided element 200 and 206, each single stripe 202 and 206, respectively, is of two adjacent members, 204 and 204', and, 210 and 210', respectively, continuously and helically extending, for a plurality of complete windings, in a clockwise direction about the braiding axis BA, becoming closely spaced within the beginning region br, continuing through the middle region mr, and remaining closely spaced at the end of the ending region er, of the respective striped braided element.

Figure 8C:
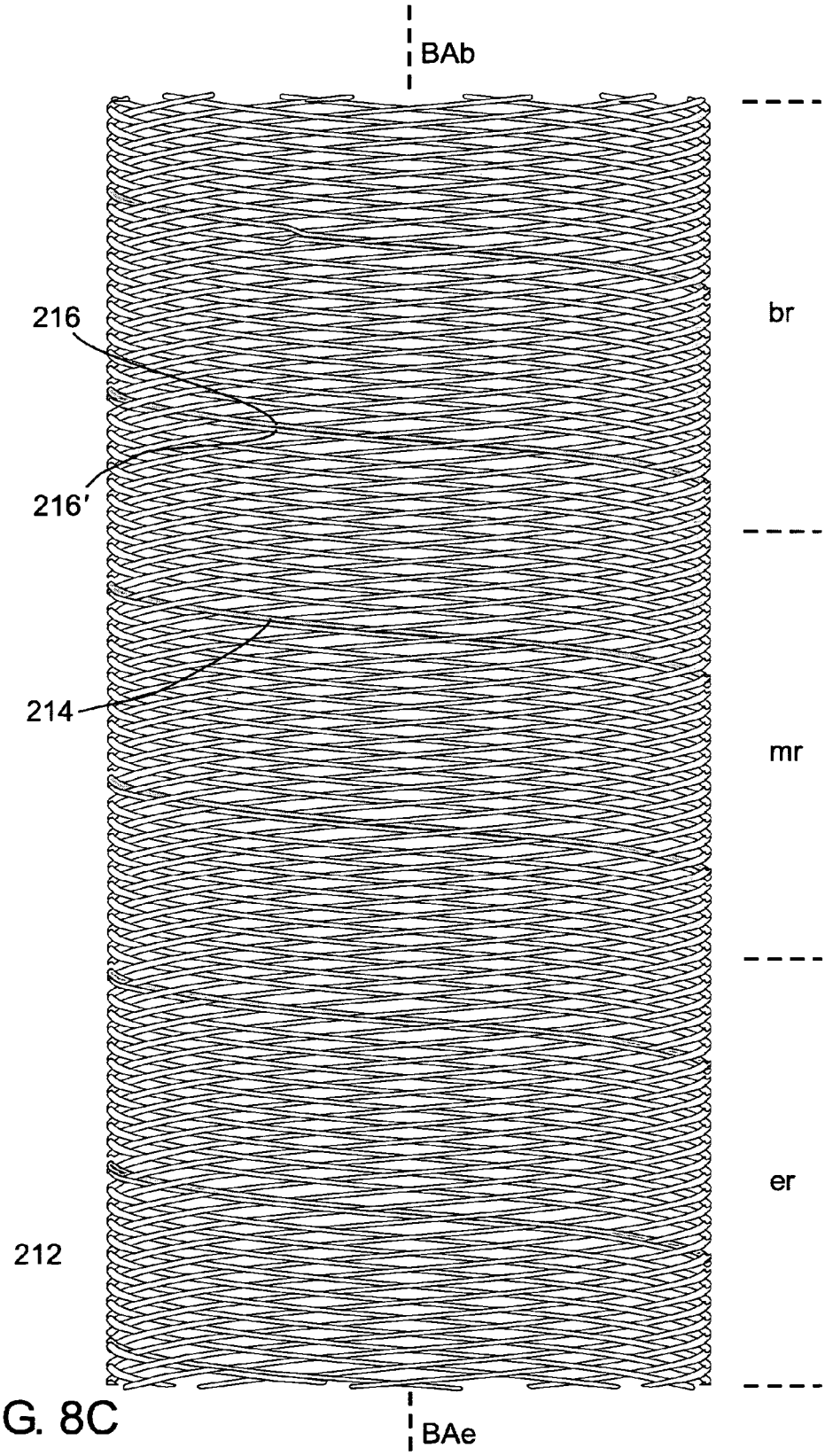
FIGS. 8C and 8D are schematic diagrams each illustrating an exemplary embodiment of a striped braided element, characterized by a one-over-two (1×2) (FIG. 8C) or a one-over-one (1×1) (FIG. 8D) braid pattern including a single stripe extending for a plurality of complete windings in a counter-clockwise direction about the braiding axis of the striped braided element in accordance with the principles of the present invention.
Figure 8D:
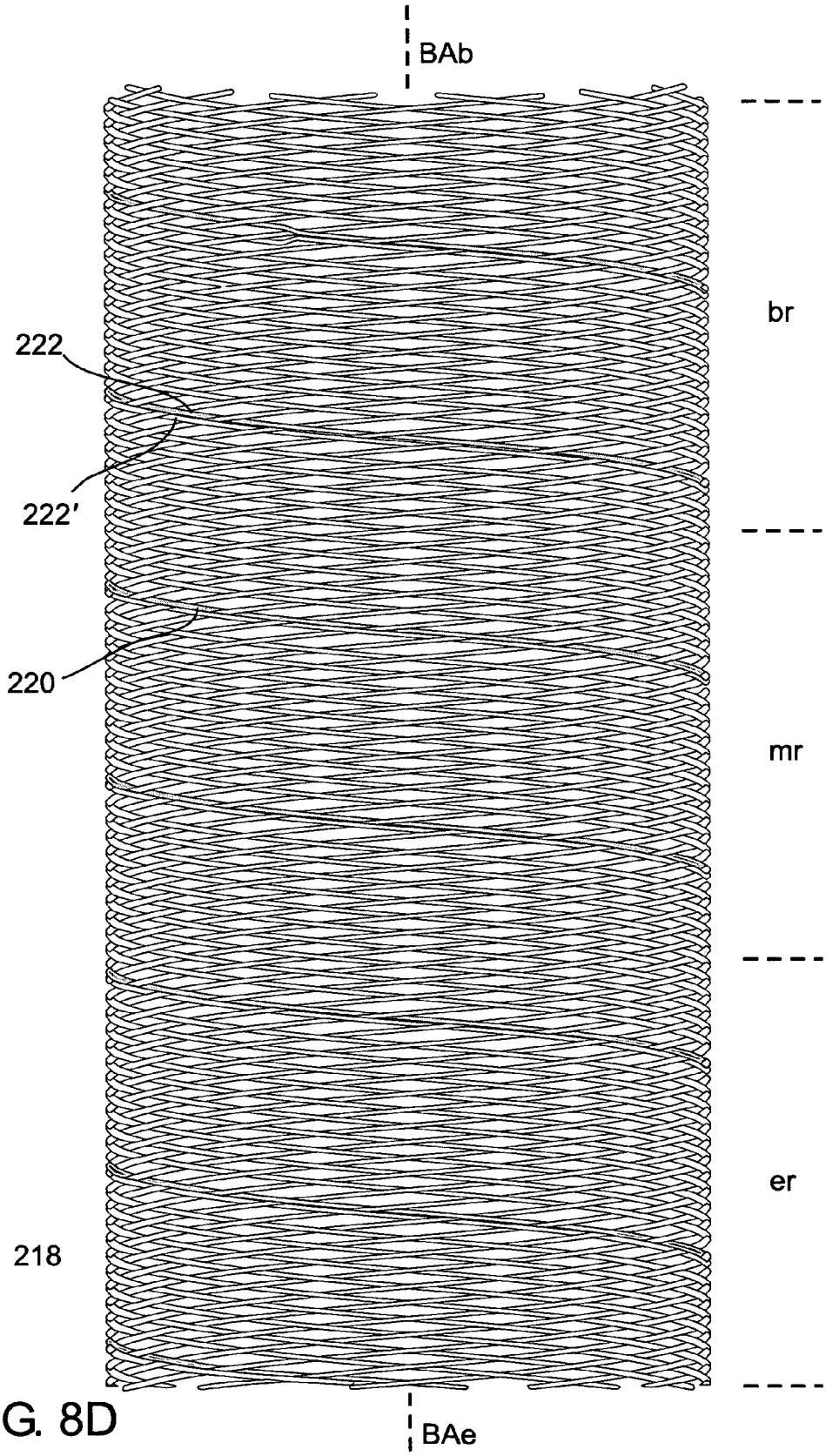

FIGS. 8C and 8D are schematic diagrams each illustrating an exemplary embodiment of a striped braided element 212 and 218, respectively, characterized by a 1×2 (FIG. 8C) or a 1×1 (FIG. 8D) braid pattern including a single stripe 214 and 220, respectively, formed by implementing the striped braiding method of the present invention.

In each striped braided element 212 and 218, each single stripe 214 and 220, respectively, is of two adjacent members, 216 and 216', and, 222 and 222', respectively, continuously and helically extending, for a plurality of complete windings, in a counter-clockwise direction about the braiding axis BA, becoming closely spaced within the beginning region br, continuing through the middle region mr, and remaining closely spaced at the end of the ending region er, of the respective striped braided element.

Figure 9A:
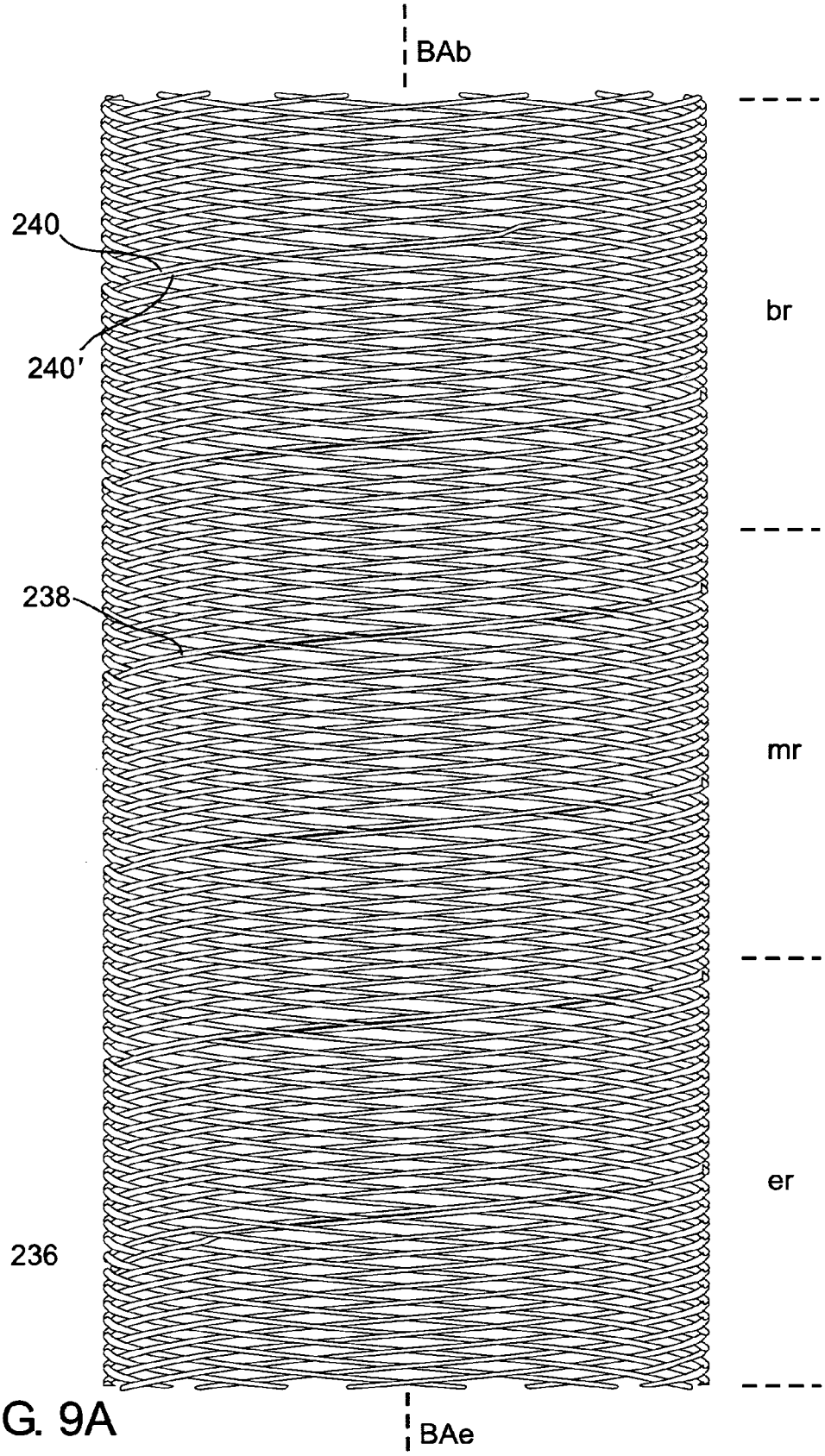
FIGS. 9A and 9B are schematic diagrams each illustrating an exemplary embodiment of a striped braided element, characterized by a one-over-two (1×2) (FIG. 9A) or a one-over-one (1×1) (FIG. 9B) braid pattern including a single stripe extending for a plurality of complete windings in a clockwise direction about the braiding axis of the striped braided element in accordance with the principles of the present invention.
Figure 9B:
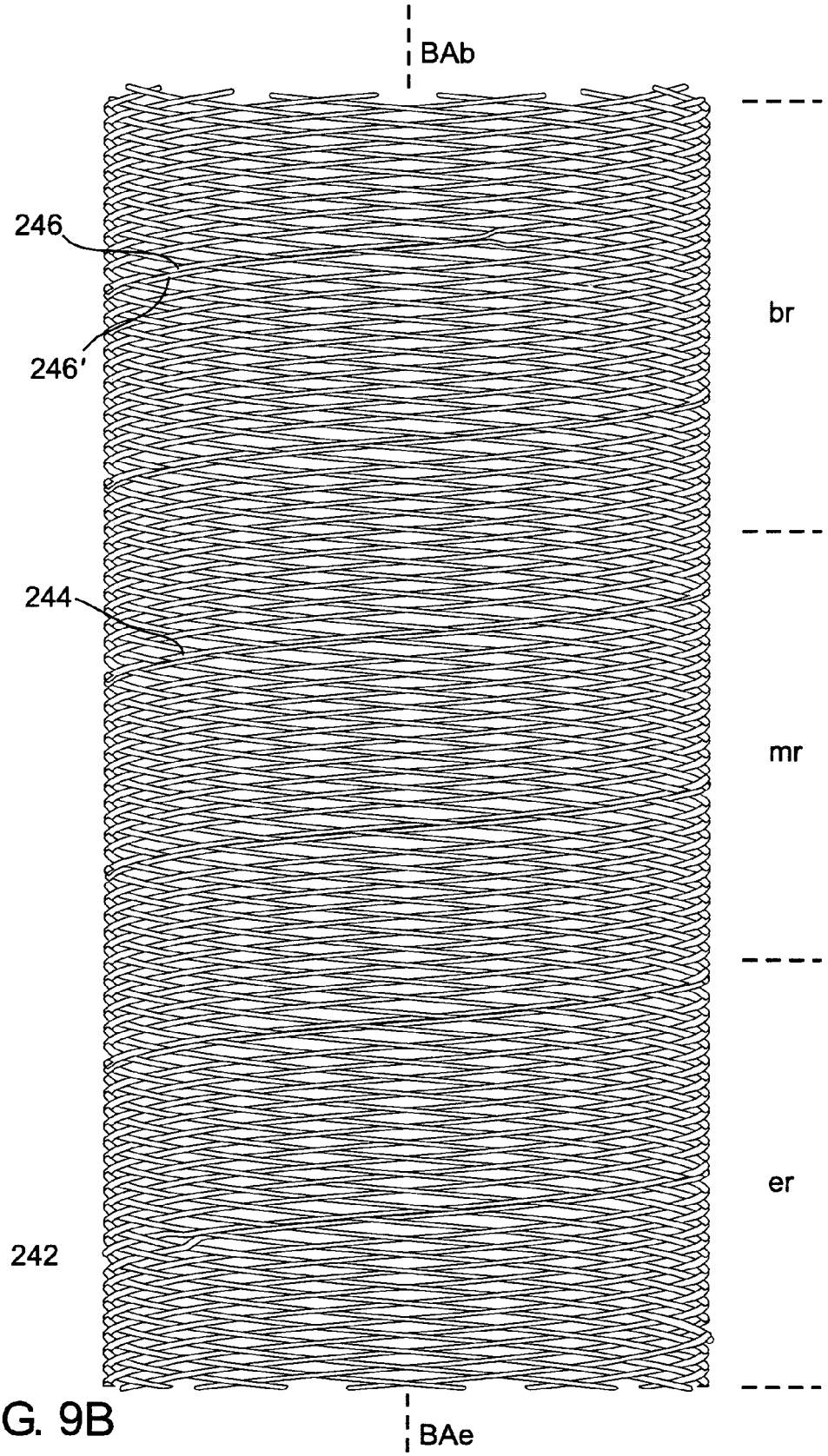

FIGS. 9A and 9B are schematic diagrams each illustrating an exemplary embodiment of a striped braided element 236 and 242, respectively, characterized by a 1×2 (FIG. 9A) or a 1×1 (FIG. 9B) braid pattern including a single stripe 238 and 244, respectively, formed by implementing the striped braiding method of the present invention.

In each striped braided element 236 and 242, each single stripe 238 and 244, respectively, is of two adjacent members, 240 and 240', and, 246 and 246', respectively, continuously and helically extending, for a plurality of complete windings, in a clockwise direction about the braiding axis BA, being closely spaced throughout the beginning of the beginning region br, continuing through the middle region mr, and remaining closely spaced at the end of the ending region er, of the respective striped braided element.

Figure 10A:
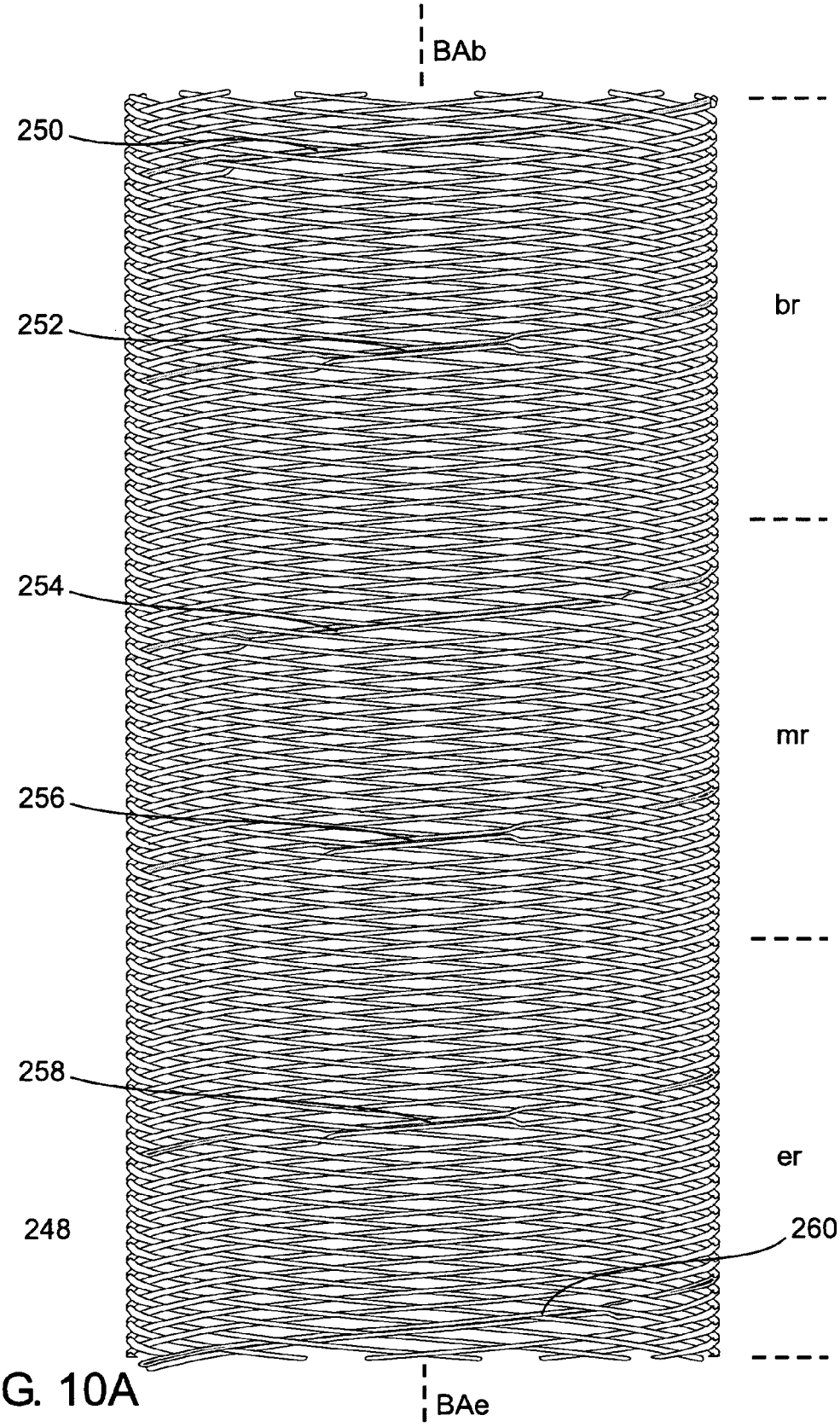
FIGS. 10A and 10B are schematic diagrams each illustrating an exemplary embodiment of a striped braided element, characterized by a one-over-two (1×2) (FIG. 10A) or a one-over-one (1×1) (FIG. 10B) braid pattern including a variety of separate stripes, each extending for less than one complete winding in a clockwise direction about the braiding axis of the striped braided element, in accordance with the principles of the present invention.
Figure 10B:
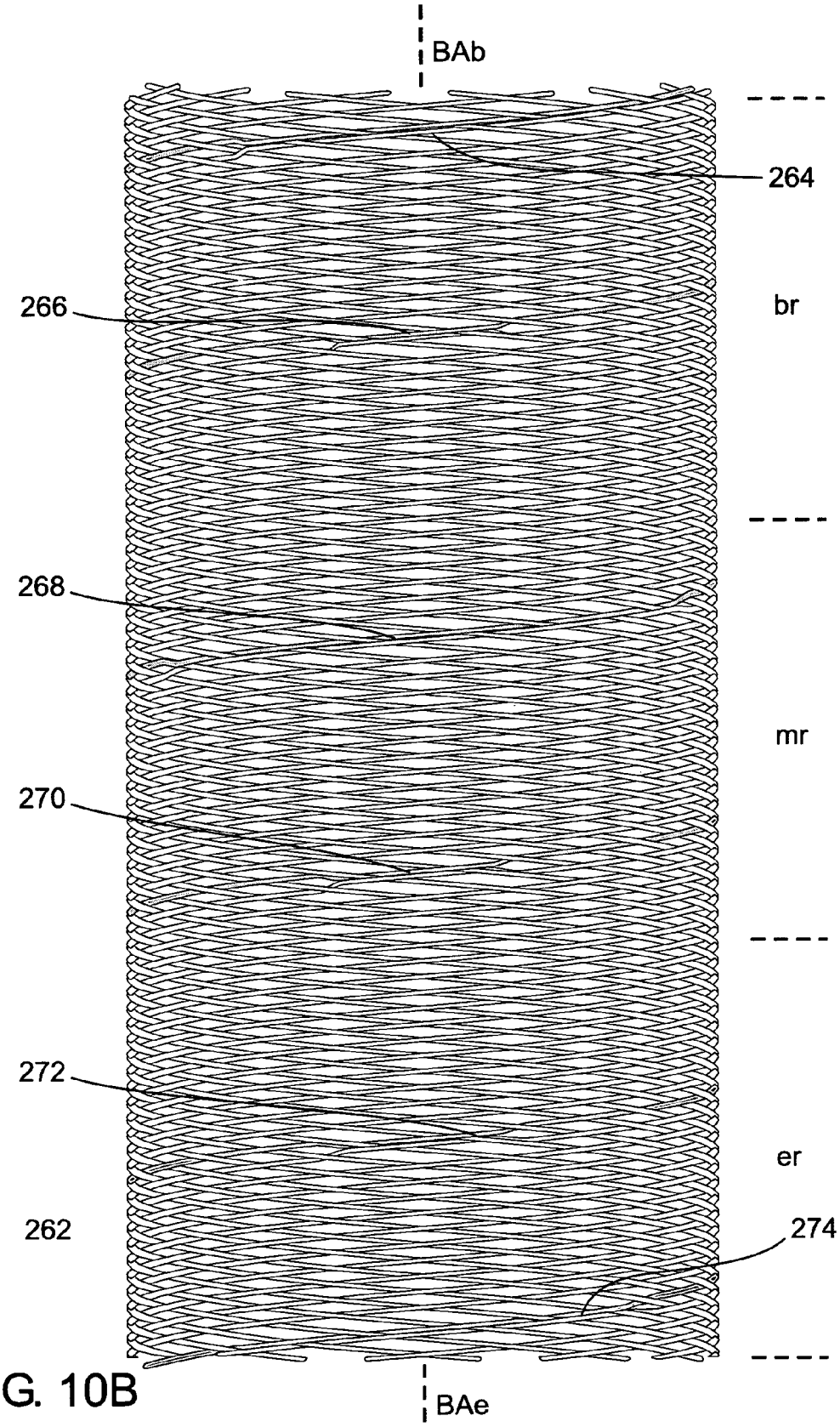

FIGS. 10A and 10B are schematic diagrams each illustrating an exemplary embodiment of a braided element 248 and 262, respectively, characterized by a 1×2 (FIG. 10A) or a 1×1 (FIG. 10B) braid pattern including a variety of separate stripes (250, 252, 254, 256, 258, and 260) and (264, 266, 268, 270, 272, and 274), respectively, formed by implementing the striped braiding method of the present invention.

In each striped braided element 248 and 262, each of the separate stripes (250, 252, 254, 256, 258, and 260) and (264, 266, 268, 270, 272, and 274), respectively, is of two adjacent members, continuously extending, for less than one complete winding, in a clockwise direction about the braiding axis BA, becoming closely spaced and separating to the normal member spacing within one complete winding of the respective striped braided element. It is to be understood that in a preferred embodiment control mechanism 50 of FIG. 5B is advantageously utilized to cyclically produce the variety of separate stripes (250, 252, 254, 256, 258, and 260) and (264, 266, 268, 270, 272, and 274).

Figure 11A:
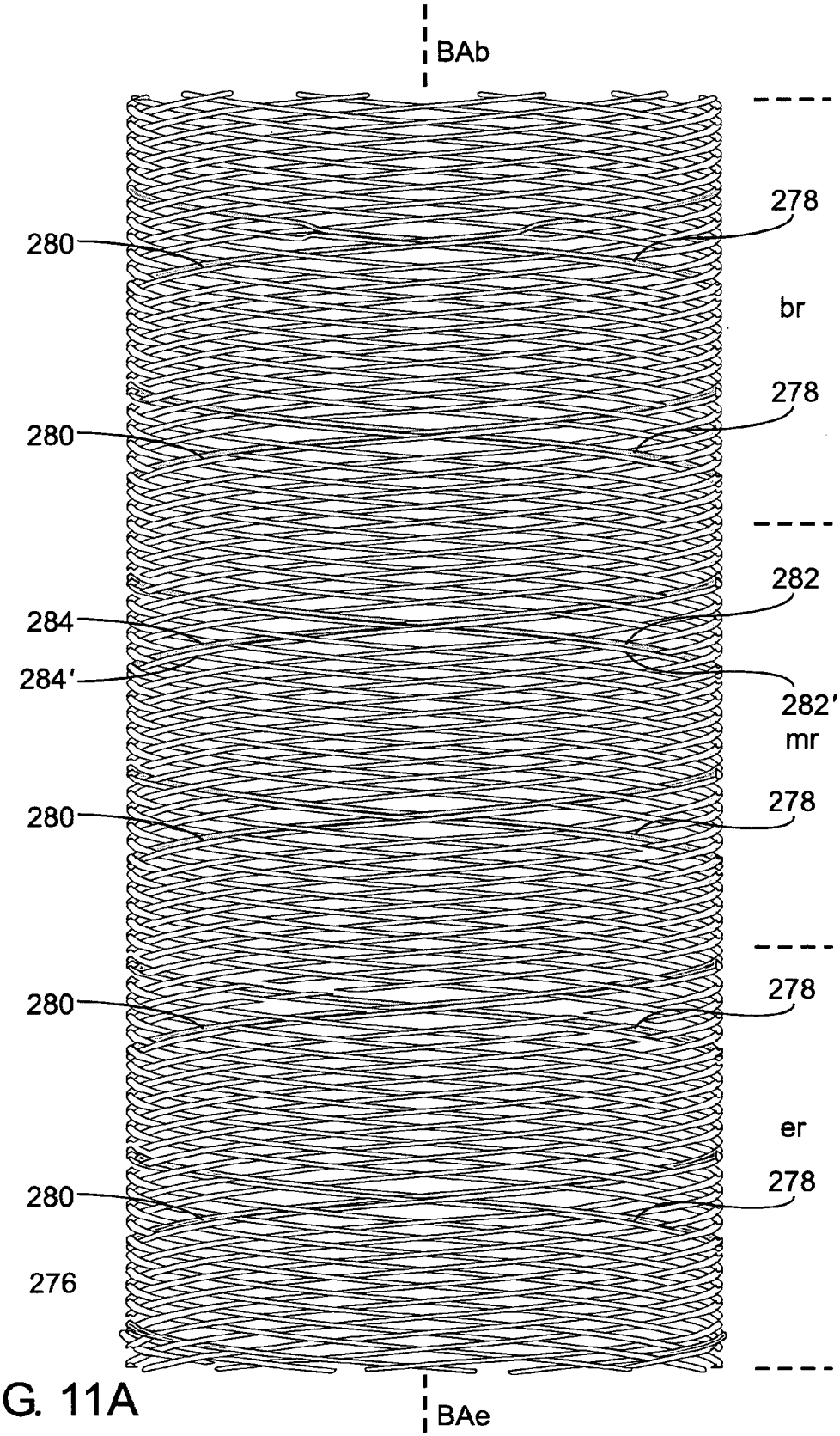
FIGS. 11A and 11B are schematic diagrams each illustrating an exemplary embodiment of a striped braided element, characterized by a one-over-two (1×2) (FIG. 11A) or a one-over-one (1×1) (FIG. 11B) braid pattern including two crossing single stripes, each extending for a plurality of complete windings, in a clockwise or counter-clockwise direction, respectively, about the braiding axis of the striped braided element, in accordance with the principles of the present invention.
Figure 11B:
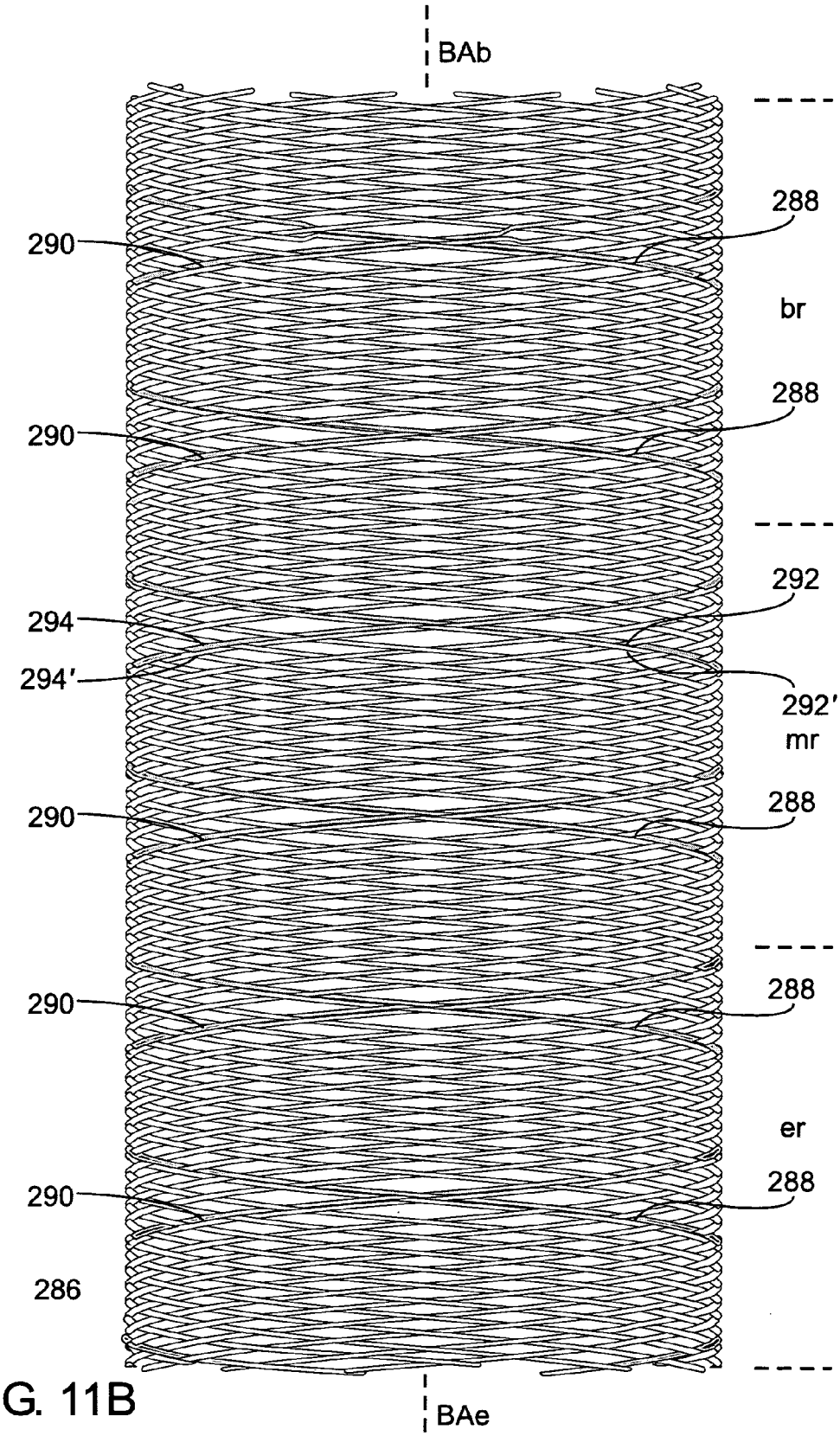

FIGS. 11A and 11B are schematic diagrams each illustrating an exemplary embodiment of a striped braided element 276 and 286, respectively, characterized by a 1×2 (FIG. 11A) or a 1×1 (FIG. 11B) braid pattern including two crossing single stripes (278 and 280) and (288 and 290), respectively, formed by implementing the striped braiding method of the present invention.

In each striped braided element 276 and 286, each of the two crossing single stripes (278 and 280) and (288 and 290), respectively, is of two adjacent members (282 and 282'; 284 and 284', respectively) and (292 and 292'; 294 and 294', respectively), each continuously and helically extending, for a plurality of complete windings, in a counter-clockwise or clockwise, respectively, direction about the braiding axis BA, becoming closely spaced within the beginning region br, continuing through the middle region mr, and remaining closely spaced at the end of the ending region er, of the respective striped braided element. Two crossing single stripes will tend to improve radio-opacity, due to the increased member density in a plane at, or in the vicinity of, the crossing point. Furthermore, having stripes in opposing directions, thus being symmetric, improves the structural stability of striped braided element 276 and 286.

Figure 12A:
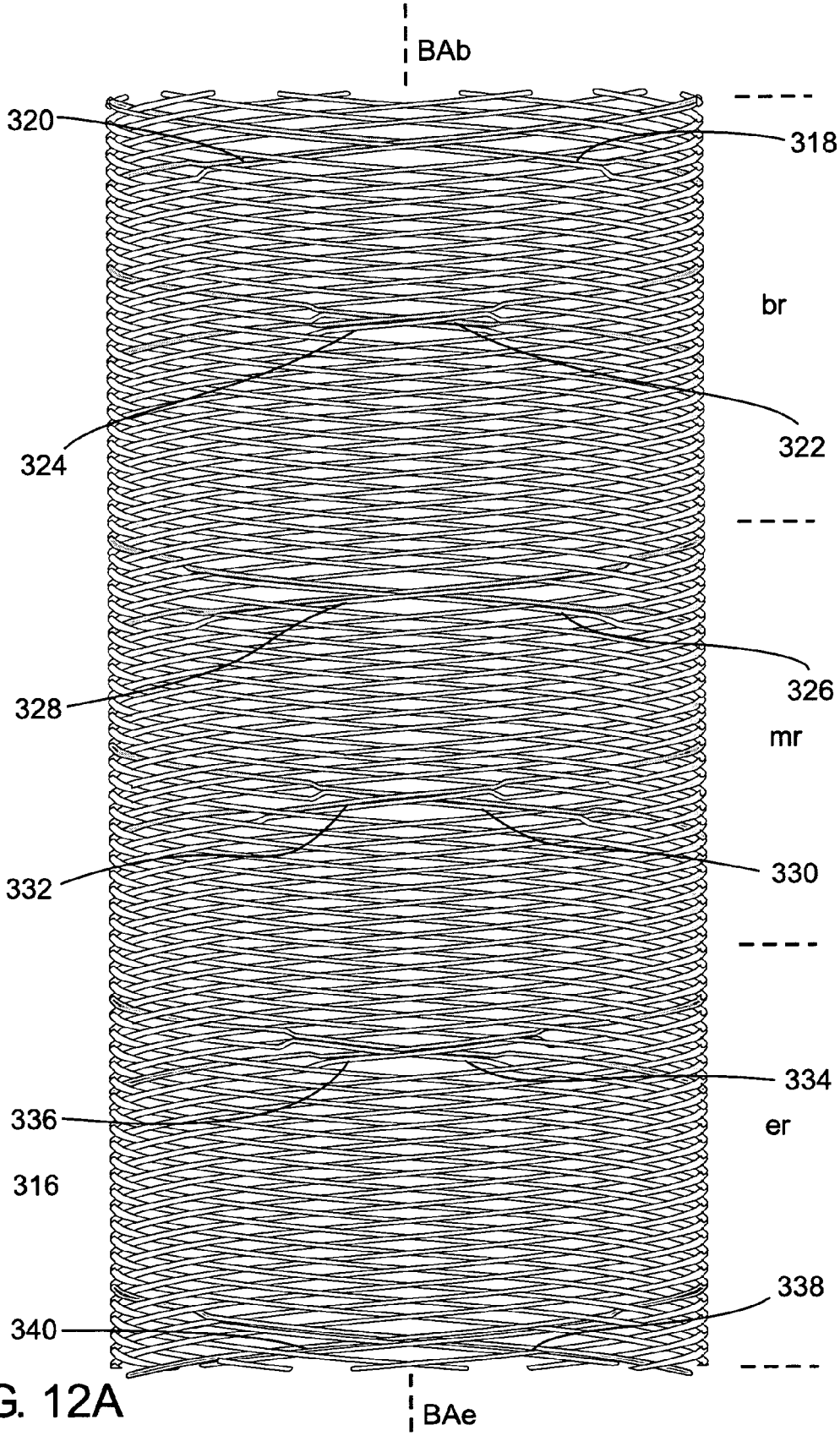
FIGS. 12A and 12B are schematic diagrams each illustrating an exemplary embodiment of a striped braided element, characterized by a one-over-two (1×2) (FIG. 12A) or a one-over-one (1×1) (FIG. 12B) braid pattern including a variety of two crossing single stripes, each extending for less than one complete winding, in a clockwise or counter-clockwise direction, respectively, about the braiding axis of the striped braided element, in accordance with the principles of the present invention.
Figure 12B:
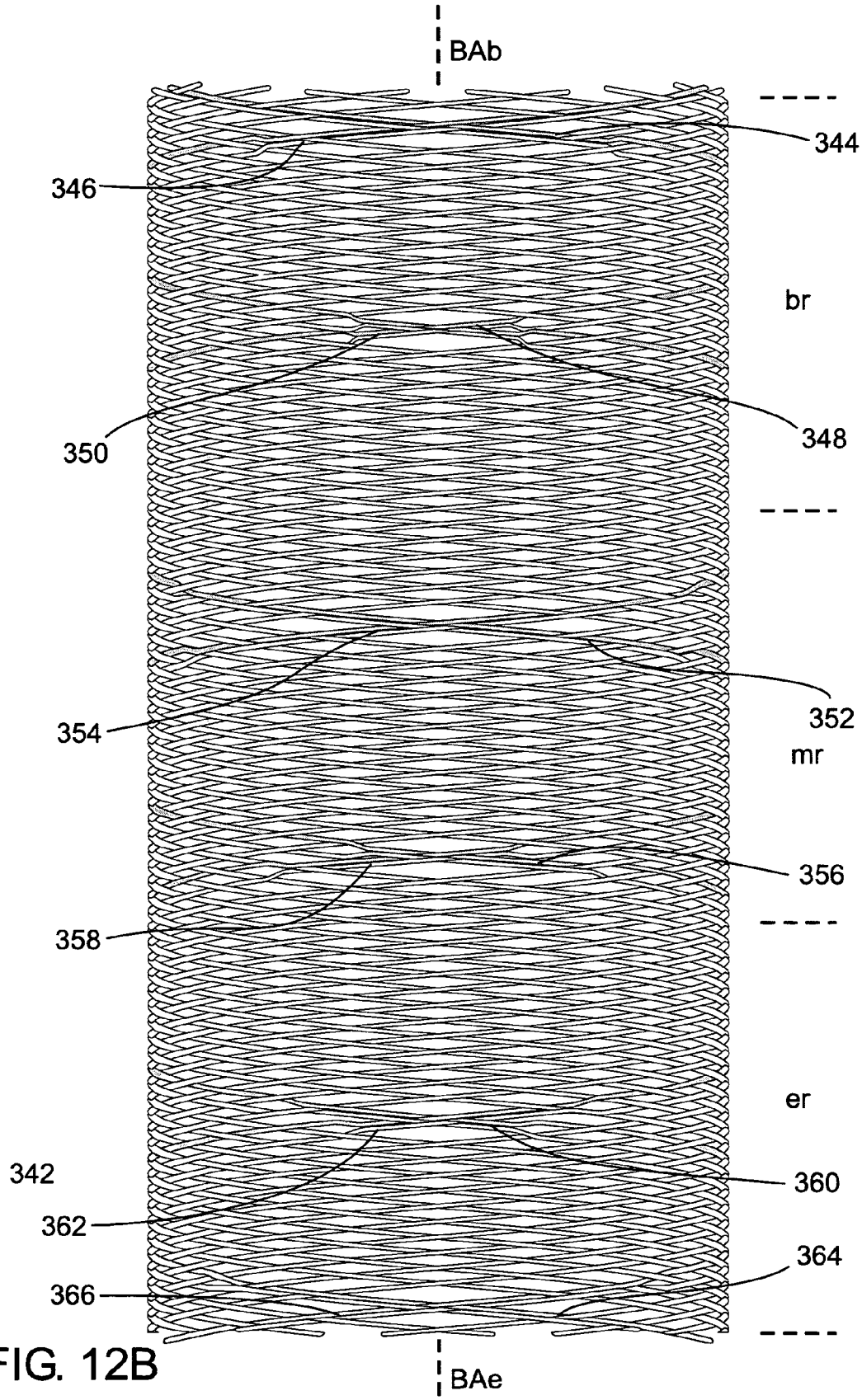

FIGS. 12A and 12B are schematic diagrams each illustrating an exemplary embodiment of a striped braided element 316 and 342, respectively, characterized by a 1×2 (FIG. 12A) or a 1×1 (FIG. 12B) braid pattern including a variety of two crossing single stripes (318 and 320; 322 and 324; 326 and 328; 330 and 332; 334 and 336; 338 and 340) and (344 and 346; 348 and 350; 352 and 354; 356 and 358; 360 and 362; 364 and 366), respectively, formed by implementing the striped braiding method of the present invention.

In each striped braided element 316 and 342, each of the two crossing single stripes (318 and 320; 322 and 324; 326 and 328; 330 and 332; 334 and 336; 338 and 340) and (344 and 346; 348 and 350; 352 and 354; 356 and 358; 360 and 362; 364 and 366), respectively, is of two adjacent members, continuously extending, for less than one complete winding, in a clockwise or counter-clockwise, respectively, direction about the braiding axis BA. Two crossing single stripes will tend to improve radio-opacity, due to the increased member density in a plane at, or in the vicinity of, the crossing point. Furthermore, having stripes in opposing directions, thus being symmetric, improves the structural stability of striped braided element 316 and 342. In a preferred embodiment, control mechanism 50 of FIG. 5B is advantageously utilized to cyclically produce the variety of separate stripes (318, 322, 326, 330, 334 and 338; 320, 324, 328, 332, 336, 340; and 344, 348, 352, 256, 360 and 364; 346, 350, 354, 358, 362 and 366).

Thus, the present invention provides an innovative differential filament tensioning procedure, for controllably and differentially adjusting tensions of filaments unwinding from filament carrier units of a braiding device, in a braiding process, for forming a striped braided element. The stripe is defined by a closer proximity of the center axis of two adjacent members of a set, as compared to the proximity of the balance of the members of the set. Preferably, the closer proximity is limited substantially by the cross-section or diameter of the members of the set being wound in the opposite direction. The striped braided element of the present invention exhibits improved radio-opacity characteristics that can be changed over the longitudinal axis of the element. Furthermore, in a preferred embodiment the present invention results in braided element having different structural characteristics that can be changed over the longitudinal axis of the element.

Thus, it is understood from the embodiments-of the invention herein described and illustrated, above, that the method for braiding a striped braided element and the striped braided element formed therefrom, of the present invention, are neither anticipated or obviously derived from prior art teachings in the field of braiding.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention.

While the invention has been described in conjunction with specific embodiments and examples thereof, it is evident that many alternatives, modifications and variations will be apparent to those skilled in the art. Accordingly, it is intended to embrace all such alternatives, modifications and variations that fall within the spirit and broad scope of the appended claims.

What is claimed is:

1. A method for braiding a striped braided element, comprising the steps of:

(a) selecting and setting specific braiding process and operating parameters, said parameters comprising a nominal tension value for members of the striped braided element and a braid pattern;

(b) operating a braiding device using said braiding process and operating parameters, for converging, in a braiding manner, a plurality of members to produce said striped braided element, said members comprising a first set of members having a common direction of winding and a sequential order, the center axis of each member of said first set of members being axially displaced relative to each other in relation to a common braiding axis, and a second set of members having an opposite common direction of winding and a sequential order, the center axis of each member of said second set of members being axially displaced relative to each other in relation to said common braiding axis, said process and parameters resulting in a braid exhibiting a uniform uninterrupted braid pattern and an average uniform distance between the center axis of members having a common direction of winding at a particular circumferential section along said common braiding axis;

(c) controllably decreasing the tension of a first member of said first set; and (d) controllably increasing the tension a second member of said first set, said second member sequentially following said first member;

whereby said differences in tensions form at least one stripe comprising two adjacent members of the same set exhibiting a significantly reduced distance between the center axis of said two adjacent members in said particular circumferential section.

2. The method according to claim 1 wherein said two adjacent members are substantially separated by the width of a member of said second set.

3. The method according to claim 1 wherein said operating a braiding device is accomplished to form said at least one stripe extending for at least one complete winding in a clockwise or counter-clockwise direction.

4. The method according to claim 1 wherein said operating a braiding device is accomplished to form said at least one stripe extending for less than a complete winding in a clockwise or counter-clockwise direction.

5. The method according to claim 1 wherein said braid pattern is a 1×1 braid pattern.

6. The method according to claim 1 wherein said braid pattern is a 1×2 braid pattern.

7. The method according to claim 1 wherein said at least one stripe comprises a plurality of stripes, at least one stripe of said plurality of stripes extending for at least one complete winding in a clockwise or counter-clockwise direction.

8. The method according to claim 1 wherein said at least one stripe comprises a plurality of stripes, at least one stripe of said plurality of stripes extending for less than a complete winding in a clockwise or counter-clockwise direction.

9. The method according to claim 1 wherein said at least one stripe comprises at least one stripe in a clockwise direction and at least one stripe in a counter-clockwise direction.

10. The method according to claim 9 wherein said at least one stripe in a clockwise direction and at least one stripe in a counter-clockwise direction are disposed in a same pair of radial planes.

11. The method according to claim 9 wherein said at least one stripe in a clockwise direction and at least one stripe in a counter-clockwise direction cross.

12. The method according to claim 1 wherein said members exhibiting a significantly reduced distance comprise said first member and the member of said first set sequentially preceding said first member.

13. The method according to claim 1 further comprising:

(e) controllably decreasing the tension of a third member of said first set, said third member being adjacent to and sequentially preceding said first member;

wherein said first and third members exhibit said significantly reduced distance.

14. The method according to claim 1 wherein said controllably decreasing the tension comprises decreasing the tension to less than 70% of said nominal tension value.

15. The method according to claim 1 wherein said controllable increasing the tension comprises increasing the tension to greater than 150% of said nominal tension value.

16. The method according to claim 1 wherein said controllably increasing the tension is accomplished by supplementing weights.

17. The method according to claim 1 wherein said controllably decreasing the tension is accomplished by removing weights.

18. The method according to claim 1, wherein at least of said controllably decreasing the tension and said controllably increasing the tension is accomplished by a cyclic control mechanism.

19. A striped braided element comprising:

a first set of members having a common direction of winding, the center axis of said first set of members being axially displaced relative to each other in relation to a common braiding axis; and a second set of members having an opposite direction of winding, the center axis of said second set of members being axially displaced relative to each other in relation to said common braiding axis, said braided element exhibiting a uniform uninterrupted braid pattern and an average uniform distance between the center axis of members having a common direction of winding at a particular circumferential section along said common braiding axis;

characterized by having at least one stripe comprising two adjacent members of the same set exhibiting a significantly reduced distance between the center axis of said adjacent members in said particular circumferential section.

20. A striped braided element according to claim 19 wherein said two adjacent members are substantially separated by the width of a member of said second set.

21. A striped braided element according to claim 19 wherein said stripe extends for at least one complete winding in a clockwise or counter-clockwise direction.

22. A striped braided element according to claim 19 wherein said stripe extends for less than one complete winding in a clockwise or counter-clockwise direction.

23. A striped braided element according to claim 19 wherein said braid pattern is a 1×1 braid pattern.

24. A striped braided element according to claim 19 wherein said braid pattern is a 1×2 braid pattern.

25. A striped braided element according to claim 19 comprising a plurality of stripes, a first stripe extending in a clockwise direction and a second stripe extending in a counter-clockwise direction.

26. A striped braided element according to claim 25 wherein at least one of said first and second stripes extend for less than a complete winding.

27. A striped braided element according to claim 25 wherein at least one of said first and second stripes extend for at least one a complete winding.

28. A striped braided element according to claim 25 wherein said first and second stripe are disposed in a same pair of radial planes.

29. A striped braided element according to claim 25 wherein said first and second stripe cross.

* * * * *